US012729504B2

(12) United States Patent
Sonoda et al.

(10) Patent No.: US 12,729,504 B2
(45) Date of Patent: Sep. 8, 2026

(54) WORK MACHINE AND METHOD FOR CONTROLLING WORK MACHINE

(71) Applicant: KOMATSU LTD., Tokyo (JP)

(72) Inventors: Takuya Sonoda, Tokyo (JP); Yoshihide Nakae, Tokyo (JP); Takashi Maeda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 424 days.

(21) Appl. No.: 18/553,257

(22) PCT Filed: May 10, 2022

(86) PCT No.: PCT/JP2022/019824

§ 371 (c)(1),
(2) Date: Sep. 29, 2023

(87) PCT Pub. No.: WO2022/264713

PCT Pub. Date: Dec. 22, 2022

(65) Prior Publication Data

US 2024/0352706 A1 Oct. 24, 2024

(30) Foreign Application Priority Data

Jun. 15, 2021 (JP) ..... 2021-099271

(51) Int. Cl.
*E02F 3/84* (2006.01)
*E02F 3/76* (2006.01)
(Continued)

(52) U.S. Cl.
CPC ..... *E02F 3/844* (2013.01); *E02F 3/764* (2013.01); *E02F 9/2004* (2013.01);
(Continued)

(58) Field of Classification Search
None
See application file for complete search history.

(56) References Cited

U.S. PATENT DOCUMENTS 5,622,226 A 4/1997 Hausman et al.
2015/0275481 A1 10/2015 Yamahata et al.
(Continued)

FOREIGN PATENT DOCUMENTS

CN 104271845 A 1/2015
CN 106609529 A 5/2017
(Continued)

OTHER PUBLICATIONS

The International Search Report for the corresponding international application No. PCT/JP2022/019824, issued on Jul. 19, 2022.
(Continued)

*Primary Examiner* — Hongye Liang
(74) *Attorney, Agent, or Firm* — Spencer Fane LLP

(57) ABSTRACT

A work machine includes a vehicle body, a work implement movably connected to the vehicle body, a plurality of actuators that are connected to the work implement and change an orientation of the work implement with respect to the vehicle body, an operating device that is operable to change the orientation of the work implement, a sensor that detects the orientation of the work implement, and a controller. The controller acquires a current orientation of the work implement, determines a target orientation of the work implement corresponding to an operation of the operating device, determines respective target stroke lengths of the plurality of actuators so that the work implement assumes the target orientation from the current orientation with a combination of stroke motions of the plurality of actuators, and controls the plurality of actuators based on the target stroke lengths.

22 Claims, 18 Drawing Sheets

(51) Int. Cl.
*E02F 9/20* (2006.01)
*E02F 9/22* (2006.01)

(52) U.S. Cl.
CPC ..... *E02F 3/7645* (2013.01); *E02F 3/765* (2013.01); *E02F 9/2203* (2013.01)

(56) References Cited

U.S. PATENT DOCUMENTS

| | | | | |
|---|---|---|---|---|
| 2016/0230367 | A1 | 8/2016 | Hendron et al. | |
| 2020/0123735 | A1* | 4/2020 | Stotlar ..... | E02F 3/841 |
| 2023/0116078 | A1 | 4/2023 | Holl et al. | |

FOREIGN PATENT DOCUMENTS

| | | | | |
|---|---|---|---|---|
| CN | 112081165 | A | | 12/2020 |
| JP | 2-20723 | A | | 1/1990 |
| JP | 4-126952 | U | | 11/1992 |
| JP | H06101247 | | * | 4/1994 |
| JP | H06101247 | A | | 4/1994 |
| JP | 9-203072 | A | | 8/1997 |
| JP | 2000-120099 | A | | 4/2000 |
| JP | 2002339390 | A | | 11/2002 |
| JP | 5624691 | B1 | | 11/2014 |

OTHER PUBLICATIONS

First Office Action received for Chinese Application No. 202280024690.7, mailed on November 15, 2025, 23 pages.

* cited by examiner

| OPERATED OPERATING MEMBER | DRIVEN ACTUATOR |
|---|---|
| LEFT LIFT LEVER | LEFT LIFT CYLINDER, RIGHT LIFT CYLINDER, DRAWBAR SHIFT CYLINDER |
| RIGHT LIFT LEVER | LEFT LIFT CYLINDER, RIGHT LIFT CYLINDER, DRAWBAR SHIFT CYLINDER |
| DRAWBAR SHIFT LEVER | LEFT LIFT CYLINDER, RIGHT LIFT CYLINDER, DRAWBAR SHIFT CYLINDER |
| ROTATION LEVER | LEFT LIFT CYLINDER, RIGHT LIFT CYLINDER, DRAWBAR SHIFT CYLINDER, ROTATION ACTUATOR |
| BLADE TILT LEVER | LEFT LIFT CYLINDER, RIGHT LIFT CYLINDER, DRAWBAR SHIFT CYLINDER, BLADE TILT CYLINDER |
| BLADE SHIFT LEVER | BLADE SHIFT CYLINDER |

FIG. 9

WORK MACHINE AND METHOD FOR CONTROLLING WORK MACHINE

CROSS-REFERENCE TO RELATED APPLICATIONS

This application is a U.S. National stage application of International Application No. PCT/JP2022/019824, filed on May 10, 2022. This U.S. National stage application claims priority under 35 U.S.C. § 119 (a) to Japanese Patent Application No. 2021-099271, filed in Japan on Jun. 15, 2021, the entire contents of which are hereby incorporated herein by reference.

BACKGROUND

Field of the Invention

The present invention relates to a work machine and a method for controlling the work machine.

Background Information

There is a work machine including a work implement such as a blade and a plurality of actuators. The orientation of the work implement is changed in accordance with the stroke motions of the plurality of actuators. The orientation of the work implement includes the height and the direction of the work implement. For example, the motor grader in Japanese Patent No. 5624691 includes a front frame, a drawbar, a circle, a blade, left and right lift cylinders, a drawbar shift cylinder, and a hydraulic motor.

The drawbar is swingably supported in the up-down direction and the left-right direction with respect to the front frame. The circle is rotatably supported with respect to the drawbar. The blade is connected to the circle. The left and right lift cylinders move the drawbar up and down. The drawbar cylinder causes the drawbar to swing to the left and right. The hydraulic motor causes the circle to rotate.

The aforementioned motor grader also includes a plurality of operating levers corresponding to each of the cylinders. For example, the left lift cylinder performs a stroke motion in accordance with the operation of a left lift lever. The right lift cylinder performs a stroke motion in accordance with the operation of a right lift lever. The drawbar shift cylinder performs a stroke motion in accordance with the operation of a drawbar shift lever. The hydraulic motor rotates in accordance with the operation of a rotation lever. The operator changes the orientation of the blade by operating the operating levers.

SUMMARY

In the aforementioned motor grader, there is a need to operate a plurality of the operating levers at the same time for the operator to make the blade assumes the target orientation. For example, in the case that the operator wants to raise only the left end of the blade, if the operator operates only the left lift lever, the left end of the blade raises as the left lift cylinder contracts, but at the same time the right end of the blade descends. Therefore, the operator must operate another lever at the same time to prevent the right end from descending when wanting to raise only the left end of the blade. As a result, operation of the work implement is not easy. An object of the present invention is to facilitate operation for changing the orientation of the work implement in the work machine.

A work machine according to a first aspect of the present invention includes a vehicle body, a work implement, a plurality of actuators, an operating device, a sensor, and a controller. The work implement is movably connected to the vehicle body. The plurality of actuators are connected to the work implement and change the orientation of the work implement with respect to the vehicle body. The operating device is operable so as to change the orientation of the work implement. The sensor detects the orientation of the work implement. The controller acquires the current orientation of the work implement. The controller determines a target orientation of the work implement corresponding to the operation of the operating device. The controller determines target stroke lengths of the plurality of actuators so that the work implement assumes the target orientation from the current orientation with a combination of stroke motions of the plurality of actuators. The controller controls the actuators based on the target stroke lengths.

A method according to a second aspect of the present invention is a method for controlling a work machine. The work machine includes a vehicle body, a work implement, and a plurality of actuators. The work implement is movably connected to the vehicle body. The plurality of actuators are connected to the work implement and change the orientation of the work implement with respect to the vehicle body. The method includes: acquiring the current orientation of the work implement; acquiring an operating command for changing the orientation of the work implement; determining a target orientation of the work implement corresponding to the operating command; determining respective target stroke lengths of the plurality of actuators so that the work implement assumes the target orientation from the current orientation with a combination of stroke motions of the plurality of actuators; and controlling the actuators based on the target stroke lengths.

According to the present invention, the target orientation of the work implement is determined in accordance with the operation of the operating device. The target stroke lengths of the plurality of actuators are determined so that the work implement assumes the target orientation from the current orientation with a combination of stroke motions of the plurality of actuators. Each of the plurality of actuators are controlled based on the determined target stroke lengths. Consequently, the work implement assumes the target orientation by a combination of the stroke motions of the plurality of actuators by means of a simple operation of the operating device. As a result, the operation for changing the orientation of the work implement is facilitated in the work machine.

BRIEF DESCRIPTION OF DRAWINGS

FIG. 9 is a table indicating correspondences between operating members operated by an operator and driven actuators.

DETAILED DESCRIPTION OF EMBODIMENT(S)

Figure 1:
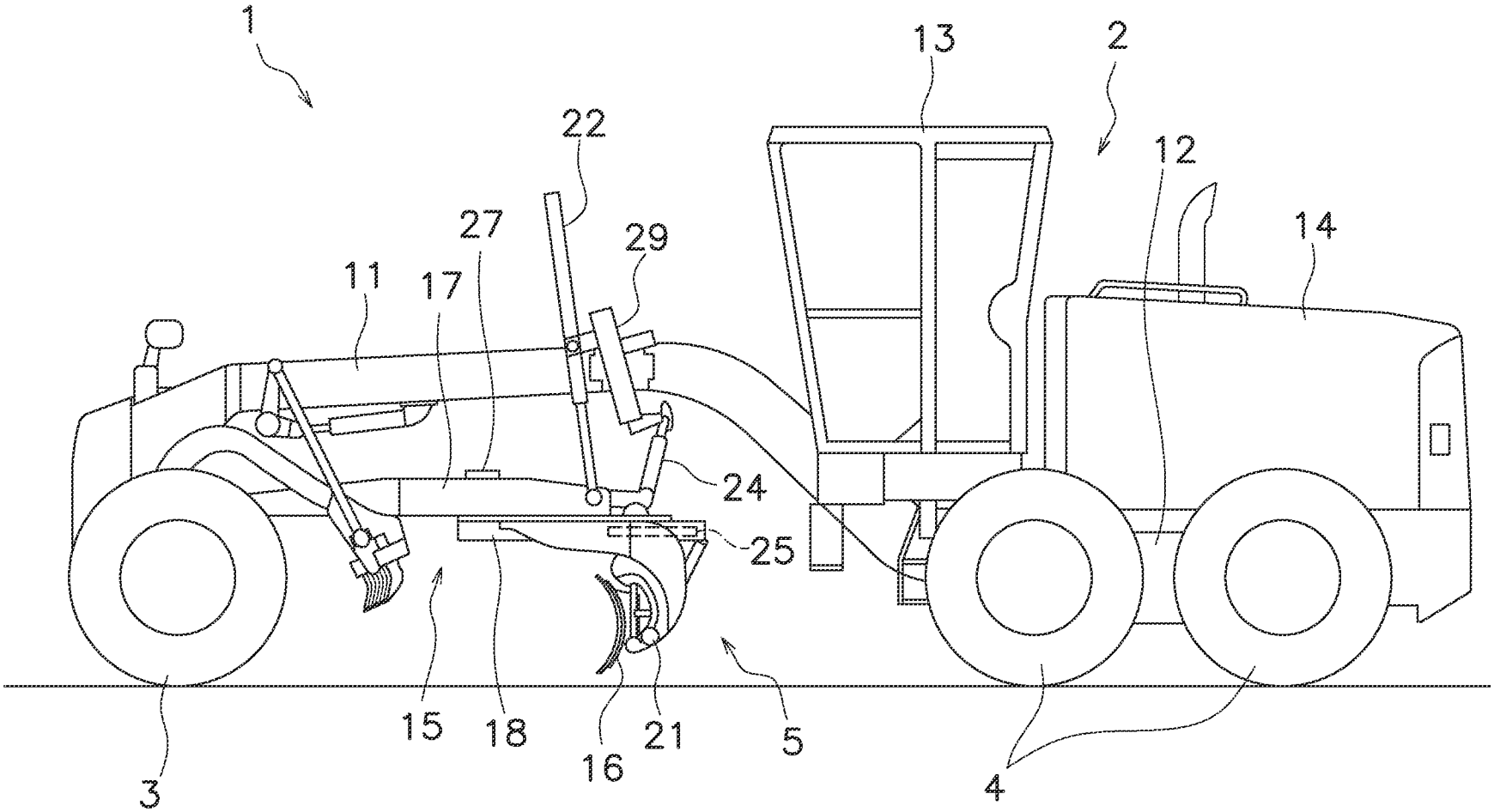
FIG. 1 is a side view of a work machine according to an embodiment.
Figure 2:
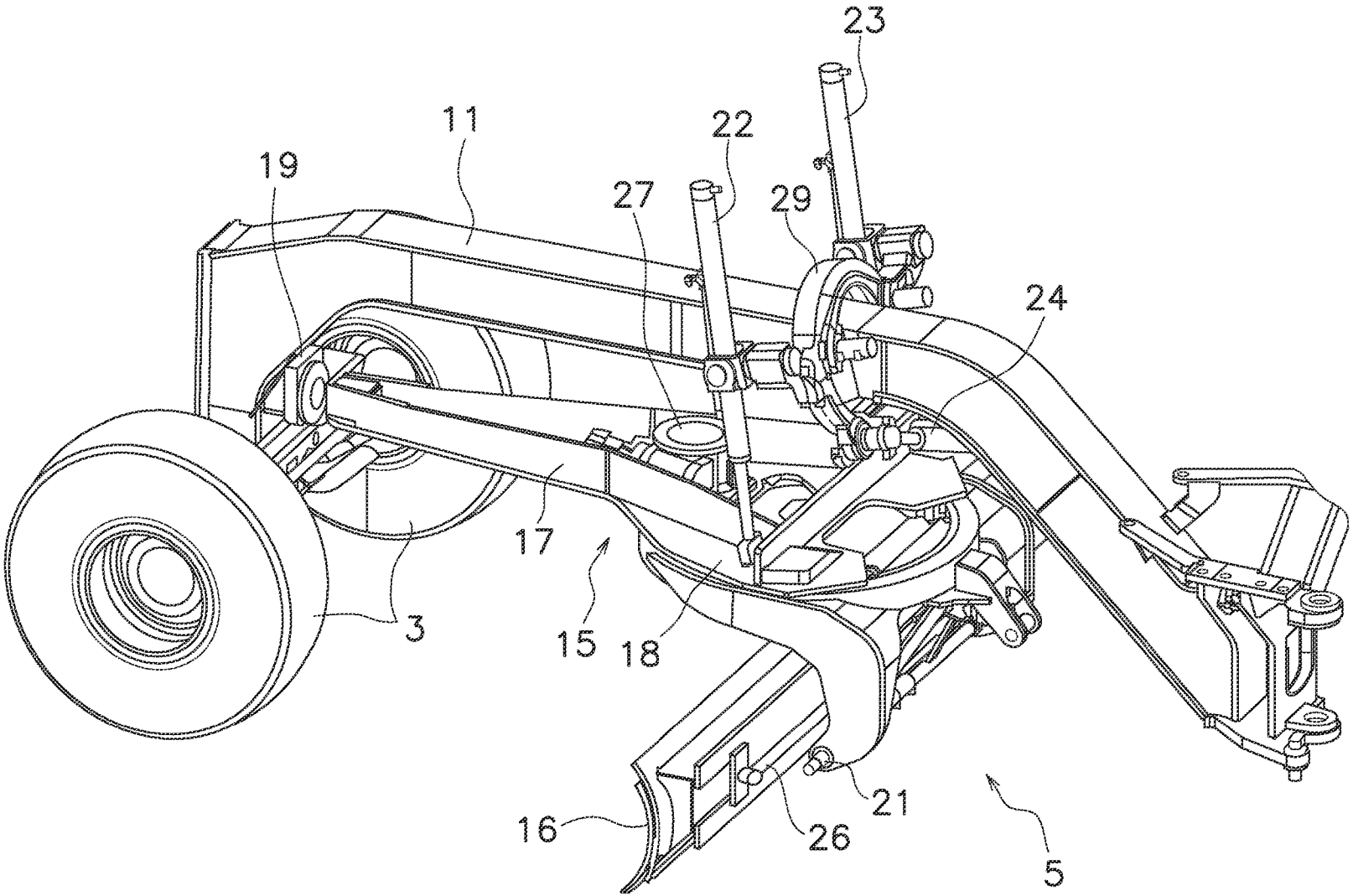
FIG. 2 is a perspective view of a front part of the work machine.

In the following description, an embodiment of the present invention will be described with reference to the accompanying drawings. FIG. 1 is a side view of a work machine 1 according to the embodiment. FIG. 2 is a perspective view of a front part of the work machine 1. As illustrated in FIG. 1, the work machine 1 includes a vehicle body 2, front wheels 3, rear wheels 4, and a work implement 5. The vehicle body 2 includes a front frame 11, a rear frame, 12, a cab 13, and a power chamber 14.

The rear frame 12 is connected to the front frame 11. The front frame 11 is able to articulate to the left and right with respect to the rear frame 12. In the following explanation, the front, rear, left, and right directions signify the front, rear, left, and right directions of the vehicle body 2 while the articulate angle is zero, that is while the front frame 11 and the rear frame 12 are straight.

The cab 12 and the power chamber 14 are disposed on the rear frame 12. An unillustrated operator's seat is disposed in the cab 13. A belowmentioned drive system is disposed in the power chamber 14. The front frame 11 extends forward from the rear frame 12. The front wheels 3 are attached to the front frame 11. The rear wheels 4 are attached to the rear frame 12.

The work implement 5 is movably connected to the vehicle body 2. The work implement 5 includes a supporting member 15 and a blade 16. The supporting member 15 is movably connected to the vehicle body 2. The supporting member 15 supports the blade 16. The supporting member 15 includes a drawbar 17 and a circle 18. The drawbar 17 is disposed below the front frame 11.

As illustrated in FIG. 2, the drawbar 17 is connected to a shaft support part 19 of the front frame 11. The shaft support part 19 is disposed in the front part of the front frame 11. The drawbar 17 extends rearward from the front part of the front frame 11. The drawbar 17 is swingably supported at least in the up-down direction and the left-right direction of the vehicle body 2 with respect to the front frame 11. For example, the shaft support part 19 includes a ball joint. The drawbar 17 is rotatably connected to the front frame 11 via the ball joint.

The circle 18 is connected to a rear part of the drawbar 17. The circle 18 is rotatably supported by the drawbar 17. The blade 16 is connected to the circle 18. The blade 16 is supported by the drawbar 17 via the circle 18. The blade 16 is supported by the circle 18 so as to be able to rotate about a tilt shaft 21. The tilt shaft 21 extends in the left-right direction. The blade 16 is supported by the circle 18 so as to be able to slide in the left-right direction.

The work machine 1 includes a plurality of actuators 22-27 for changing the orientation of the work implement 5. The plurality of actuators 22-27 include a plurality of hydraulic cylinders 22-26. The plurality of hydraulic cylinders 22-26 are connected to the work implement 5. The plurality of hydraulic cylinders 22-26 extend and contract due to hydraulic pressure. The plurality of hydraulic cylinders 22-26 change the orientation of the work implement 5 with respect to the vehicle body 2 by extending and contracting. In the following explanation, the extension and contraction of the hydraulic cylinders is referred to as a "stroke motion."

Specifically, the plurality of hydraulic cylinders 22-26 include a left lift cylinder 22, a right lift cylinder 23, a drawbar shift cylinder 24, a blade tilt cylinder 25, and a blade shift cylinder 26. The left lift cylinder 22 and the right lift cylinder 23 are disposed apart from each other in the left-right direction. The left lift cylinder 22 is connected to the left portion of the drawbar 17. The right lift cylinder 23 is connected to the right portion of the drawbar 17. The left lift cylinder 22 and the right lift cylinder 23 are connected so as to be able to swing to the left and right with respect to the drawbar 17.

The left lift cylinder 22 and the right lift cylinder 23 are connected so as to be able to swing to the left and right with respect to the front frame 11. Specifically, the left lift cylinder 22 and the right lift cylinder 23 are connected to the front frame 11 via a lifter bracket 29. The lifter bracket 29 is connected to the front frame 11. The lifter bracket 29 supports the left lift cylinder 22 and the right lift cylinder 23 so as to be swingable to the left and right. The drawbar 17 swings up and down about the shaft support part 19 due to the stroke motions of the left lift cylinder 22 and the right lift cylinder 23. As a result, the blade 16 moves up and down.

The drawbar shift cylinder 24 is coupled to the drawbar 17 and the front frame 11. The drawbar shift cylinder 24 is connected to the front frame 11 via the lifter bracket 29. The drawbar shift cylinder 24 is swingably connected to the front frame 11. The drawbar shift cylinder 24 is swingably connected to the drawbar 17. The drawbar shift cylinder 24 extends diagonally downward from the front frame 11 toward the drawbar 17. The drawbar shift cylinder 24 extends to the left and right from one side to the opposite side of the front frame 11. The drawbar 17 swings to the left and right about the shaft support part 19 due to the stroke motions of the drawbar shift cylinder 24.

As illustrated in FIG. 1, the blade tilt cylinder 25 is connected to the circle 18 and the blade 16. The blade 16 rotates about the tilt shaft 21 due to the stroke motion of the blade tilt cylinder 25. As illustrated in FIG. 2, the blade shift cylinder 26 is connected to the circle 18 and the blade 16. The blade 16 slides to the right and left with respect to the circle 18 due to the stroke motion of the blade tilt cylinder 25.

The plurality of actuators 22-27 include a rotation actuator 27. The rotation actuator 27 is connected to the drawbar 17 and the circle 18. The rotation actuator 27 causes the circle 18 to rotate with respect to the drawbar 17. Consequently, the blade 16 rotates about a rotating axis that extends in the up-down direction.

Figure 3:
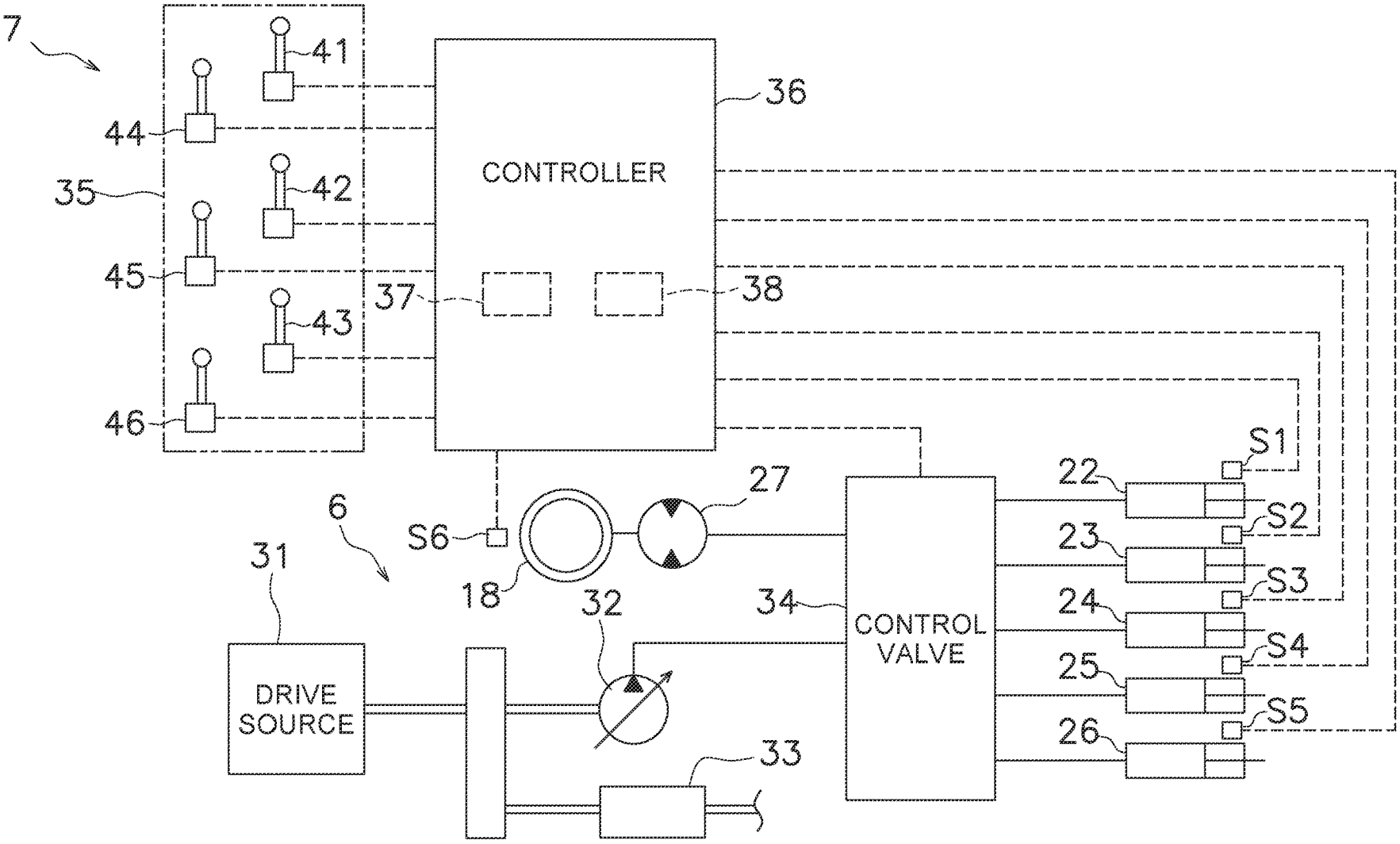
FIG. 3 is a schematic view of a drive system and a control system of the work machine.

FIG. 3 is a schematic view illustrating the drive system 6 and a control system 7 of the work machine 1. As illustrated in FIG. 3, the work machine 1 includes a driving source 31, a hydraulic pump 32, a power transmission device 33, and a control valve 34. The driving source 31 is, for example, an internal combustion engine. Alternatively, the driving source 31 may be an electric motor or a hybrid between an internal combustion engine and an electric motor. The hydraulic pump 32 is driven by the driving source 31 to discharge hydraulic fluid.

The control valve 34 is connected to the hydraulic pump 32 and the plurality of hydraulic cylinders 22-26 via a hydraulic circuit. The control valve 34 includes a plurality of valves connected to each of the plurality of hydraulic cylinders 22-26. The control valve 34 controls the flow rate of the hydraulic fluid supplied from the hydraulic pump 32 to the plurality of hydraulic cylinder 22-26.

In the present embodiment, the rotation actuator 27 is a hydraulic motor. The control valve 34 is connected to the hydraulic pump 32 and the rotation actuator 27 via a hydraulic circuit. The control valve 34 controls the flow rate of hydraulic fluid supplied from the hydraulic pump 32 to the rotation actuator 27. The rotation actuator 27 may also be an electric motor.

The power transmission device 33 transmits the driving power from the driving source 31 to the rear wheels 4. The power transmission device 33 may also include a torque converter and/or a plurality of speed change gears. Alternatively, the power transmission device 33 may be transmission of another type such as a hydrostatic transmission (HST) or a hydraulic mechanical transmission (HMT).

Figure 4:
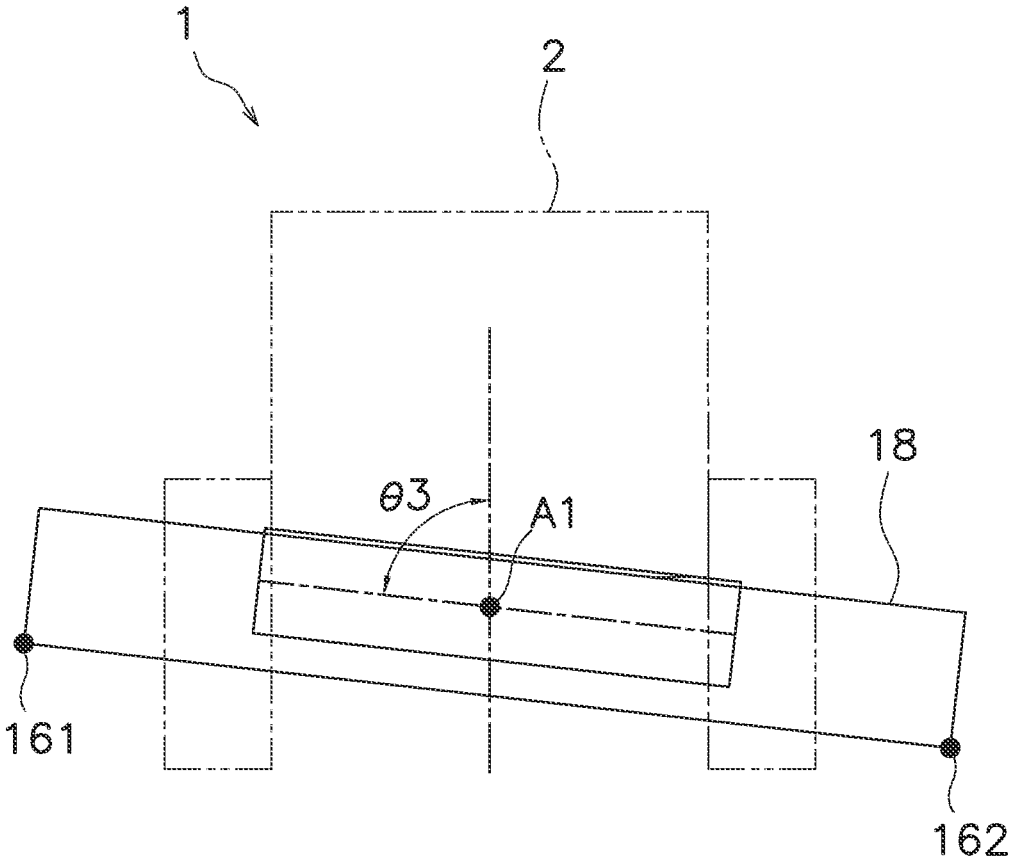
FIG. 4 is a schematic rear view of the work machine illustrating an orientation of the work implement.

As illustrated in FIG. 3, the work machine 1 includes an operating device 35 and a controller 36. The operating device 35 is operable by an operator in order to change the orientation of the work implement 5. The orientation of the work implement 5 is defined by a plurality of parameters. The plurality of parameters indicate the position and direction of the blade 16 with respect to the vehicle body 2. FIG. 4 is a schematic rear view of the work machine 1 illustrating the orientation of the work implement 5. As illustrated in FIG. 4, the plurality of parameters include the height of a left end part 161 and the height of a right end part 162 of the blade 16.

Figure 5:
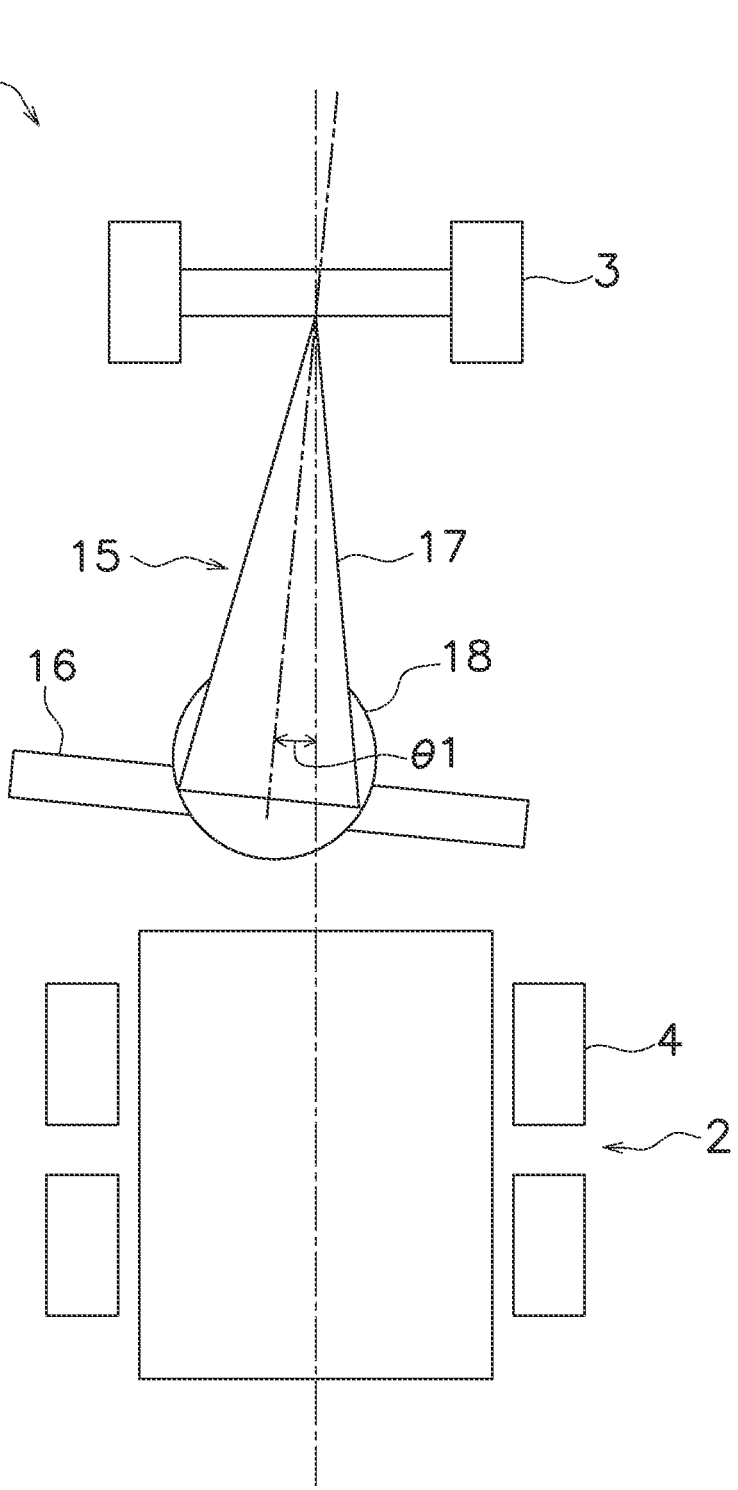
FIG. 5 is a schematic plan view of the work machine illustrating an orientation of the work implement.

The plurality of parameters include a yaw angle θ1, a pitch angle θ2, and a roll angle θ3 of the drawbar 17. FIG. 5 is a schematic plan view of the work machine 1 illustrating the orientation of the work implement 5. As illustrated in FIG. 5, the yaw angle θ1 of the drawbar 17 is the inclination angle in the left-right direction of the drawbar 17 with respect to the front-back direction of the vehicle body 2. The yaw angle θ1 of the drawbar 17 may also be the inclination angle in the left-right direction of the drawbar 17 with respect to the front-back direction of the front frame 11. The position of the blade 16 in the left-right direction changes in accordance with the yaw angle θ1 of the drawbar 17.

Figure 6:
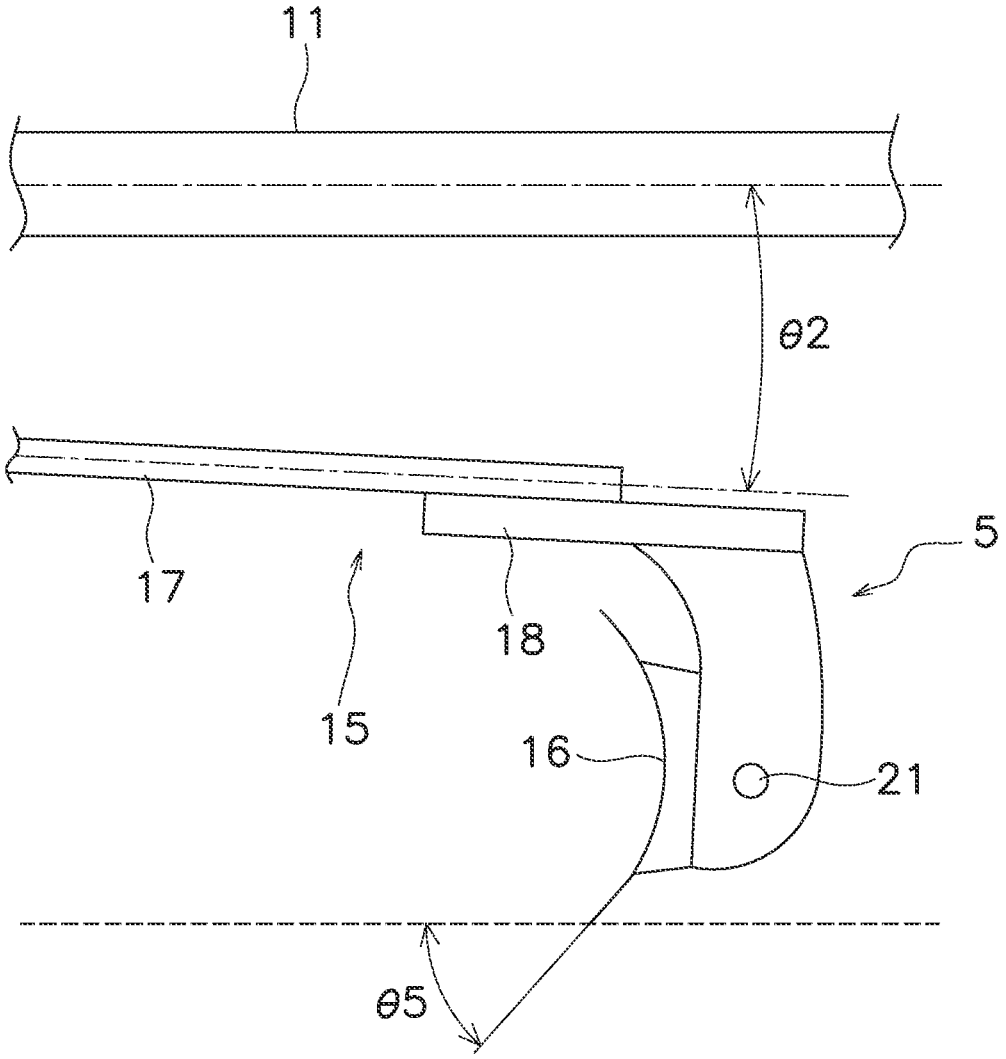
FIG. 6 is a schematic side view of the work machine illustrating an orientation of the work implement.

FIG. 6 is a schematic side view of the work machine 1 illustrating the orientation of the work implement 5. As illustrated in FIG. 6, the pitch angle θ2 of the drawbar 17 is the inclination angle in the up-down direction of the drawbar 17 with respect to the front-back direction of the vehicle body 2. As illustrated in FIG. 4, the roll angle θ3 of the drawbar 17 is the inclination angle of the drawbar 17 about a roll axis A1 that extends in the front-back direction of the vehicle body 2.

Figure 7:
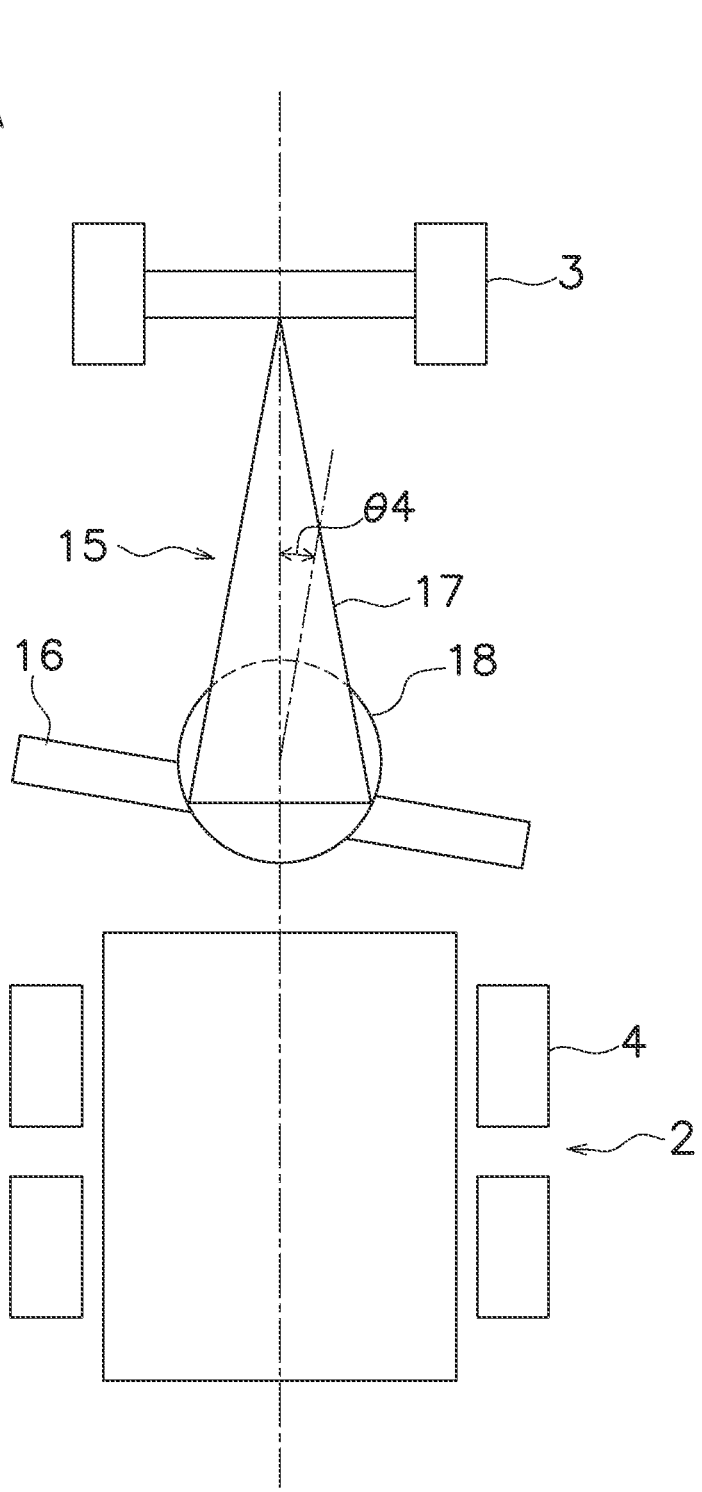
FIG. 7 is a schematic plan view of the work machine illustrating an orientation of the work implement.
Figure 8:
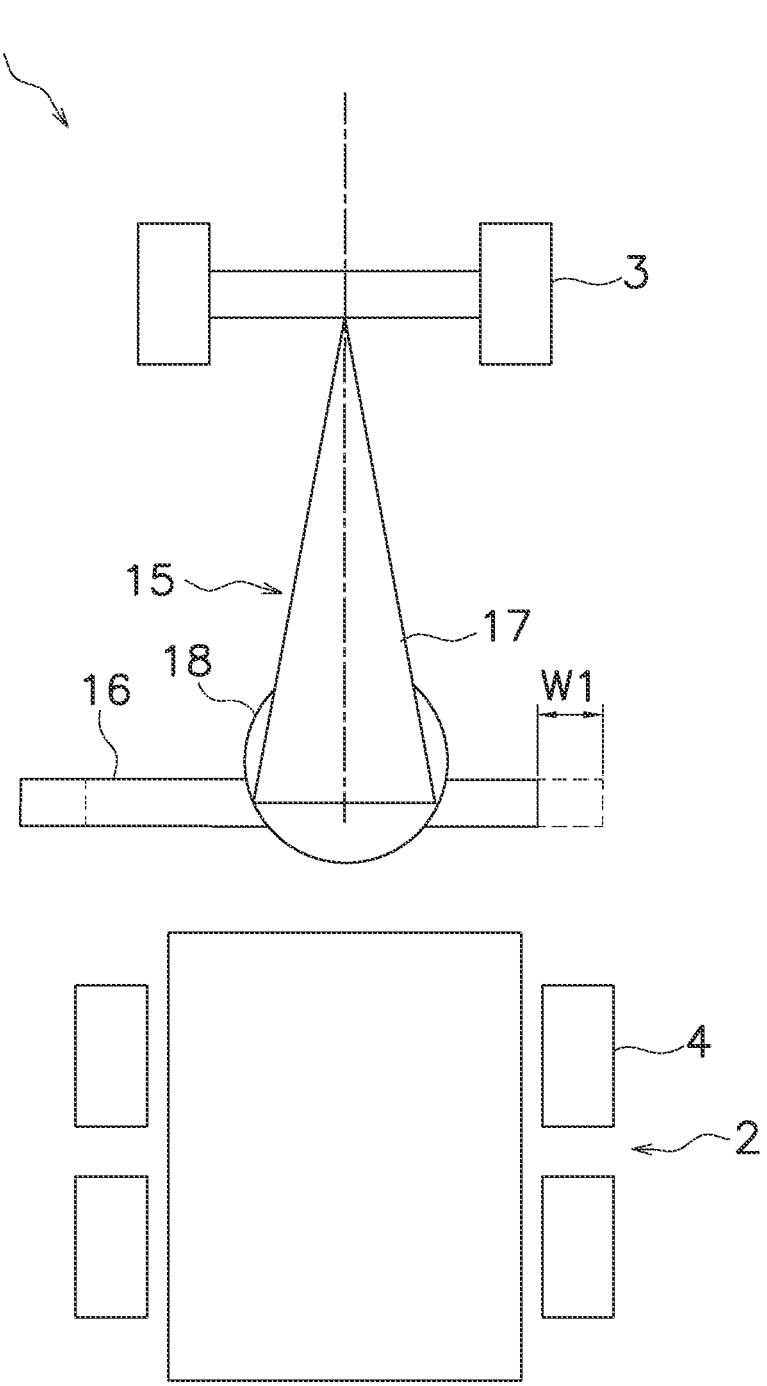
FIG. 8 is a schematic plan view of the work machine illustrating an orientation of the work implement.

The plurality of parameters also include a rotation angle θ4 of the circle 18, a tilt angle θ5 of the blade 16, and a shift amount W1 of the blade 16. FIG. 7 is a schematic plan view of the work machine 1 illustrating the orientation of the work implement 5. As illustrated in FIG. 7, the rotation angle θ4 of the circle 18 is the rotation angle θ4 of the circle 18 with respect to the front-back direction of the vehicle body 2. As illustrated in FIG. 6, the tilt angle θ5 of the blade 16 is the inclination angle of the blade 16 about the tilt shaft 21 that extends in the left-right direction. FIG. 8 is a schematic plan view of the work machine 1 illustrating the orientation of the work implement 5. As illustrated in FIG. 8, the shift amount W1 of the blade 16 is the sliding amount in the left-right direction of the blade 16 with respect to the circle 18.

The operating device 35 is operable by an operator in order to change the abovementioned parameters. The operating device 35 includes a plurality of operating members 41-46. The plurality of operating members 41-46 are respectively provided in correspondence to the height of the left end part 161 and the height of the right end part 162 of the blade 16, the yaw angle θ1 of the drawbar 17, the rotation angle θ4 of the circle 18, the tilt angle θ5 of the blade 16, and the shift amount W1 of the blade 16 among the plurality of the abovementioned parameters.

The plurality of operating members 41-46 include a left lift lever 41, a right lift lever 42, a drawbar shift lever 43, a rotation lever 44, a blade tilt lever 45, and a blade shift lever 46. The left lift lever 41 is operated for changing the height of the left end part 161 of the blade 16. The right lift lever 42 is operated for changing the height of the right end part 162 of the blade 16.

The drawbar shift lever 43 is operated for changing the yaw angle θ1 of the drawbar 17. The rotation lever 44 is operated for changing the rotation angle θ4 of the circle 18. The blade tilt lever 45 is operated for changing the tilt angle θ5 of the blade 16. The blade shift lever 46 is operated for changing the shift amount W1 of the blade 16. The plurality of operating members 41-46 output signals indicating the operations on the operating members 41-46 by the operator.

The controller 36 causes the work machine 1 to travel by controlling the driving source 31 and the power transmission device 33. In addition, the controller 36 moves the work implement 5 by controlling the hydraulic pump 32 and the control valve 34. The controller 36 includes a processor 37 and a storage device 38. The processor 37 is, for example, a CPU and executes a program for controlling the work machine 1. The storage device 38 includes a memory such as a RAM or a ROM and an auxiliary storage device such as an SSD or an HDD. The storage device 38 stores programs and data for controlling the work machine 1.

As illustrated in FIG. 3, the work machine 1 includes a plurality of sensors S1-S6 for detecting the orientation of the work implement 5. The plurality of sensors S1-S6 are, for example, magnetic sensors. However, the plurality of sensors S1-S6 may each be another type of sensor such as an optical sensor. The plurality of sensors S1-S5 detect the stroke lengths of the abovementioned plurality of hydraulic cylinders 22-26. The plurality of sensors S1-S5 include a left lift sensor S1, a right lift sensor S2, a drawbar shift sensor S3, a blade tilt sensor S4, and a blade shift sensor S5.

The left lift sensor S1 detects the stroke length of the left lift cylinder 22. The right lift sensor S2 detects the stroke length of the right lift cylinder 23. The drawbar shift sensor S3 detects the stroke length of the drawbar shift cylinder 24.

The blade tilt sensor S4 detects the stroke length of the blade tilt cylinder 25. The blade shift sensor S5 detects the stroke length of the blade shift cylinder 26.

The plurality of sensors S1-S6 include a rotation sensor S6. The rotation sensor S6 detects the rotation angle θ4 of the circle 18. The plurality of sensors S1-S6 output signals indicating the detected stroke lengths and the rotation angle θ4.

The controller 36 determines the orientation of the work implement 5 based on the detection signals from the plurality of sensors S1-S6. That is, the controller 36 calculates the current values of the abovementioned plurality of parameters based on the signals from the plurality of sensors S1-S6. As indicated above, the controller 36 changes the orientation of the work implement 5 by controlling the plurality of actuators 22-27 in accordance with the operations of the plurality of operating members 41-46. In the following explanation, the orientation of the work implement 5 signifies the orientation of the work implement 5 with respect to the front frame 11. Alternatively, the orientation of the work implement 5 signifies the orientation of the work implement 5 with respect to the vehicle body 2 when the articulate angle is zero. The control for changing the orientation of the work implement 5 executed by the controller 36 will be explained below.

Figure 10:
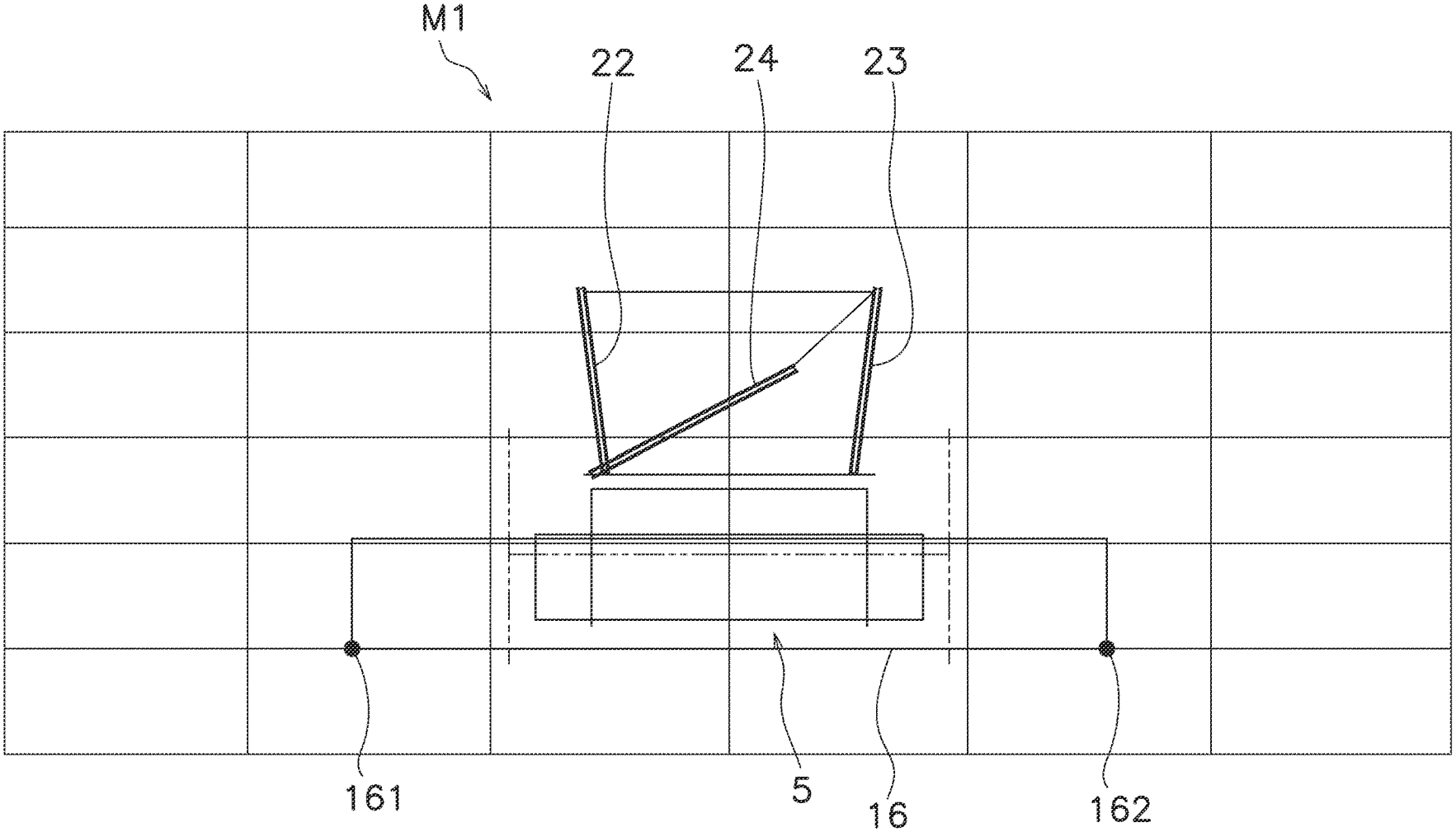
FIG. 10 is a rear view of a geometric model illustrating an orientation of the work implement.
Figure 11:
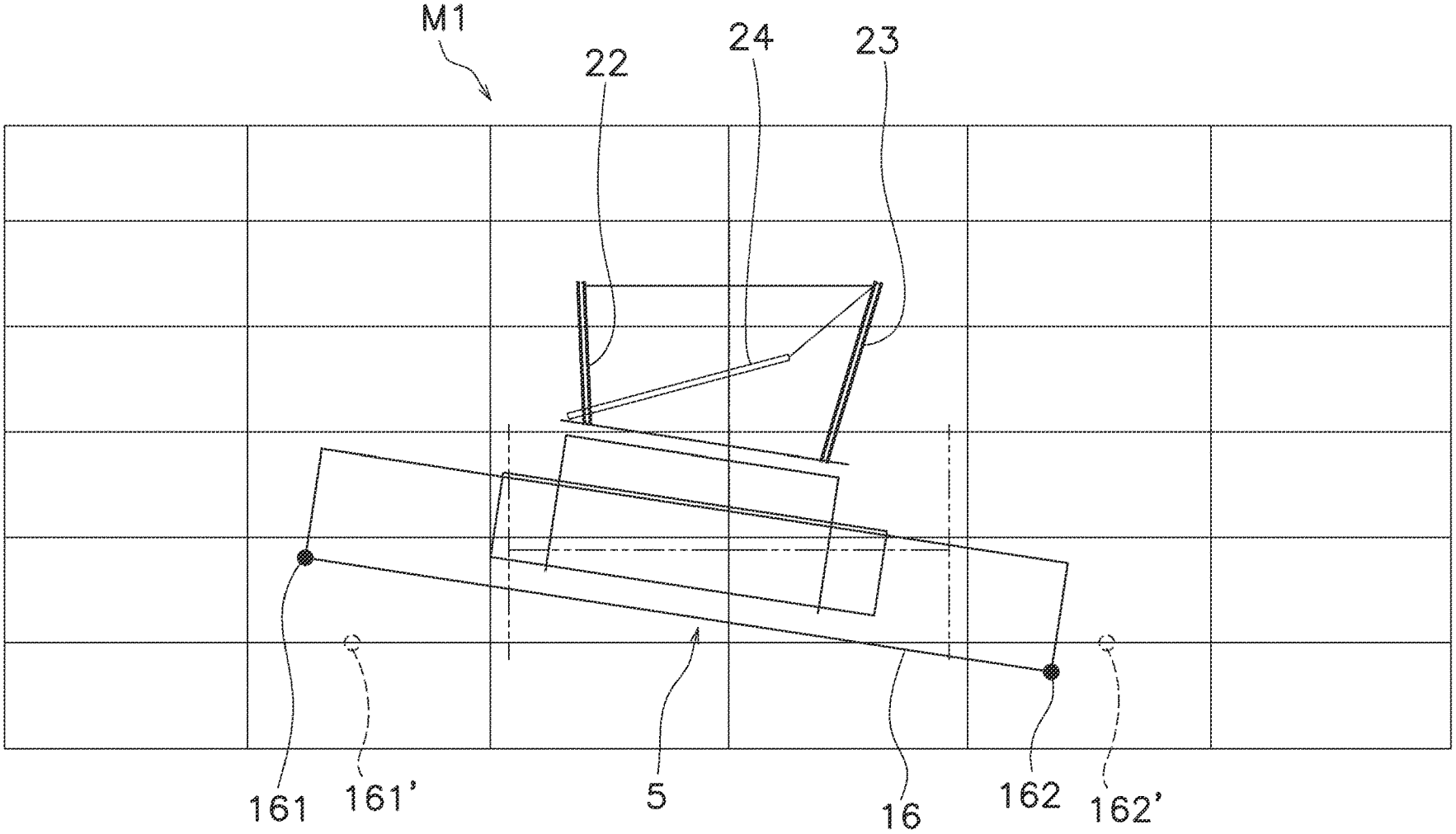
FIG. 11 is a rear view of a geometric model illustrating an orientation of the work implement.

FIG. 9 is a table indicating the correspondences between the operating members operated by the operator and the driven actuators. In the work machine 1, the plurality of parameters that indicate the orientation of the work implement 5 change in accordance with the motion of one actuator due to the abovementioned structure of the work implement 5. For example, FIGS. 10 and 11 are rear views of geometric models M1 that indicate the orientation of the work implement 5. The geometric models M1 indicate the geometric positional relationships of each portion of the work implement 5 interconnected with the motions of the actuators. The controller 36 calculates the positions and angles of the drawbar 17, the circle 18, and the blade 16 corresponding to the stroke lengths of the hydraulic cylinders 22-26 and the rotation angle θ4 of the rotation actuator 27, based on the geometric model M1.

FIG. 10 illustrates the work implement 5 in an initial state. FIG. 11 illustrates the work implement 5 when the left lift cylinder 22 is contracted from the initial state. In FIG. 11, the actuators other than the left lift cylinder 22 are maintained in the initial states. As illustrated in FIG. 11, the left end part 161 of the blade 16 rises upward from the position 161' of the initial state due to the left lift cylinder 22 contracting. However, the right end part 162 of the blade 16 descends from the position 162' of the initial state. The blade 16 also moves to the left from the position of the initial state. That is, the height of the left end part 161 of the blade 16, the height of the right end part 162 of the blade 16, and the yaw angle θ1 of the drawbar 17 change in accordance with the stroke motion of the left lift cylinder 22.

Figure 12:
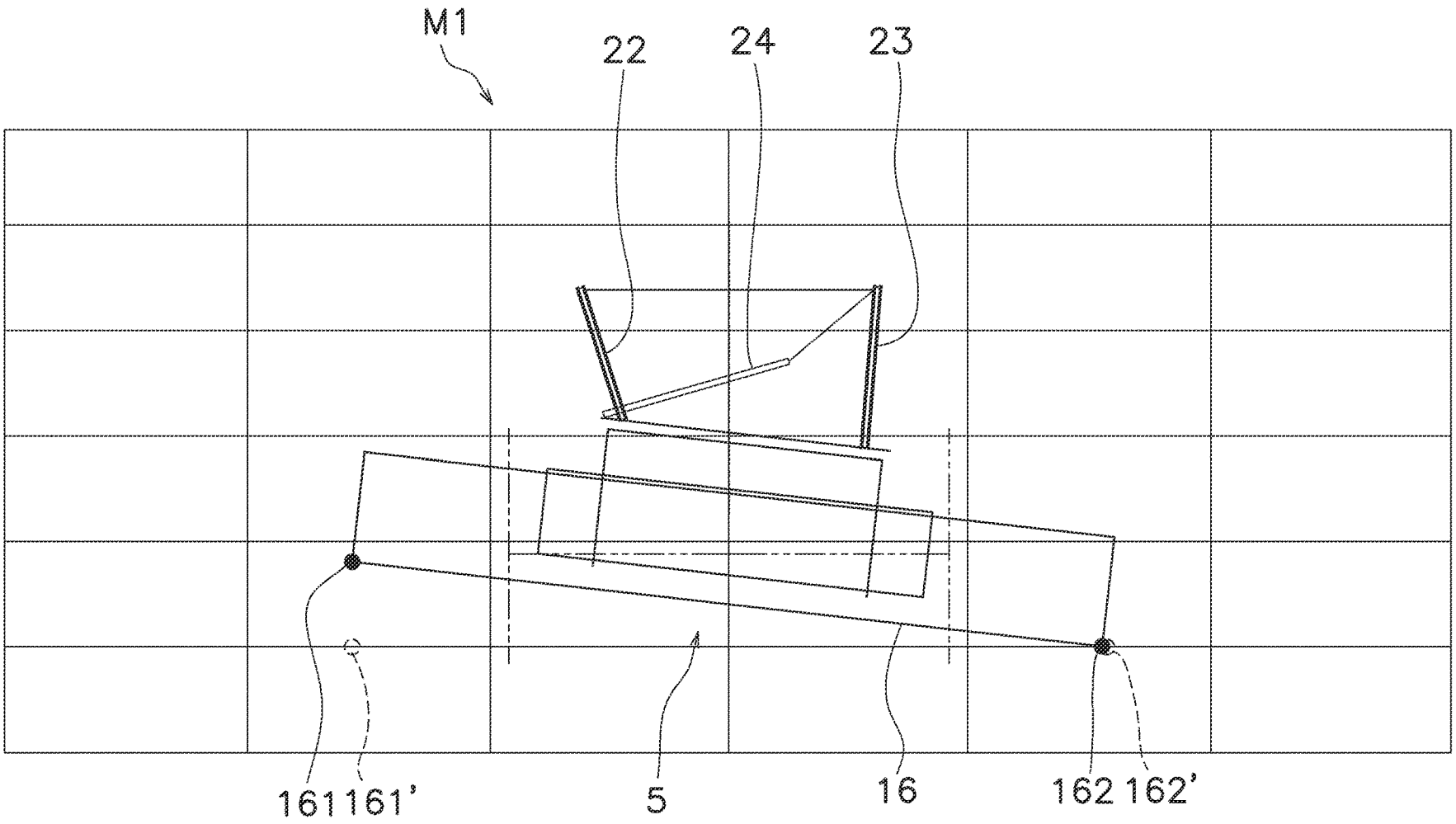
FIG. 12 is a rear view of a geometric model illustrating an orientation of the work implement.

Therefore, when only the left lift cylinder 22 is actuated in accordance with the operation of the left lift lever 41, not only does the height of the left end part 161 of the blade 16 change, but the height of the right end part 162 of the blade 16 and the position in the left-right direction of the drawbar 17 also change. Accordingly, as illustrated in FIG. 12, when the left lift lever 41 is operated, the controller 36 performs a control for changing the height of the left end part 161 of the blade 16 in accordance with the operation of the left lift lever 41 and also controls the left lift cylinder 22, the right lift cylinder 23, and the drawbar shift cylinder 24 so that the height of the right end part 162 of the blade 16 and the yaw angle θ1 of the drawbar 17 are held constant.

For example, when the left lift lever 41 is operated so as to raise the left end part 161 of the blade 16, the controller 36 causes the left lift cylinder 22 to contract. Consequently, the left end part 161 of the blade 16 rises upward. The controller 36 also causes the right lift cylinder 23 to contract. Consequently, the right end part 162 of the blade 16 is prevented from descending. The controller 36 also causes the drawbar shift cylinder 24 to contract. Consequently, the change of the yaw angle θ1 of the blade 16 is prevented.

Figure 13:
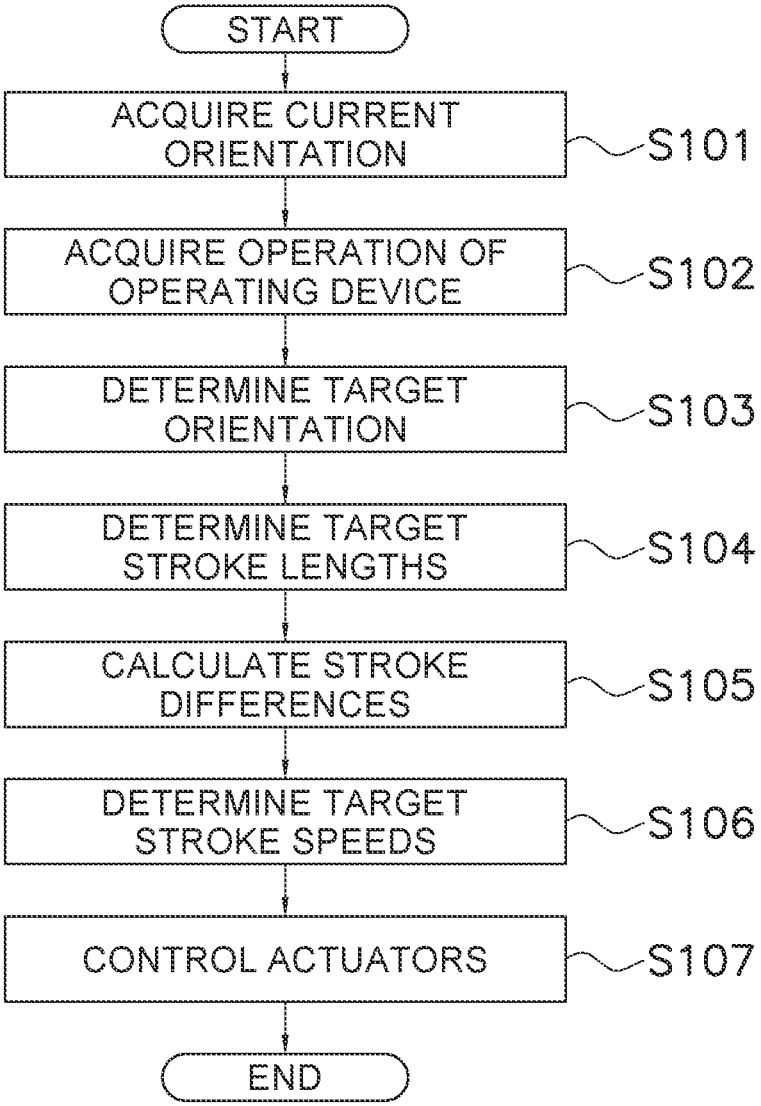
FIG. 13 is a flow chart of a control process for changing the orientation of the work implement.

Specifically, FIG. 13 is a flow chart of processing executed by the controller 36 for changing the orientation of the work implement 5. In step S101 as illustrated in FIG. 13, the controller 36 acquires the current orientation of the work implement 5. The controller 36 acquires the current stroke lengths of the hydraulic cylinders 22-26 and the current rotation angle θ4 of the circle 18 based on signals from the plurality of sensors S1-S6. The controller 36 calculates the abovementioned plurality of parameters that indicate the orientation of the work implement 5 based on the current stroke lengths of the hydraulic cylinders 22-26 and the current rotation angle θ4 of the circle 18.

In step S102, the controller 26 acquires the operation of the operating device 35. The controller 36 receives signals indicating the operation of the abovementioned operating members from any of the plurality of operating members 41-46.

In step S103, the controller 36 determines a target orientation. The controller determines the target orientation in accordance with the operation of the operating members. For example, when the left lift lever 41 is operated, the pitch angle θ2 and the roll angle θ3 of the drawbar 17 are calculated as the target orientation so that the height of the left end part 161 of the blade 16 becomes the height corresponding to the operation of the left lift lever 41 while the height of the right end part 162 of the blade 16 and the position in the left-right direction of the drawbar 17 are held constant. The yaw angle θ1 of the drawbar 17 is maintained as the value of the initial state.

In step S104, the controller 36 determines target stroke lengths. The controller 36 calculates the target stroke lengths of the hydraulic cylinders 22-26 so that the work implement 5 assumes the target orientation. In the above example, the controller 36 calculates a first target stroke length of the left lift cylinder 22, a second target stroke length of the right lift cylinder 23, and a third target stroke length of the drawbar shift cylinder 24 that reproduce the pitch angle θ2 and the roll angle θ3 of the drawbar 17 that indicates the abovementioned target orientation.

In step S105, the controller 36 calculates stroke differences. The stroke differences are the differences between the target stroke lengths and the current stroke lengths. In the above example, the controller 36 determines the difference between the current stroke length and the first target stroke length of the left lift cylinder 22 as a first stroke difference. The controller 36 determines the difference between the current stroke length and the second target stroke length of the right lift cylinder 23 as a second stroke difference. The controller 36 determines the difference between the current stroke length and the third target stroke length of the drawbar shift cylinder 24 as a third stroke difference.

In step S106, the controller 36 determines target stoke speeds of the hydraulic cylinders 22-26 so that the work implement 5 assumes the target orientation. The controller 36 determines the target stoke speeds based on the respective stroke differences of hydraulic cylinders 22-26. In the above example, the controller 36 determines a first target stoke speed of the left lift cylinder 22 based on the first stroke difference. The controller 36 determines a second target stoke speed of the right lift cylinder 23 based on the second stroke difference. The controller 36 determines a third target stoke speed of the drawbar shift cylinder 24 based on the third stroke difference.

For example, the controller 36 determines the first target stoke speed of the left lift cylinder 22 by multiplying the first stroke difference by a predetermined first gain. The controller 36 determines the second target stoke speed of the right lift cylinder 23 by multiplying the second stroke difference by a predetermined second gain. The controller 36 determines the third target stoke speed of the drawbar shift cylinder 24 by multiplying the third stroke difference by a predetermined third gain.

The controller 36 controls the left lift cylinder 22 based on feedback control so that the stroke speed of the left lift cylinder 22 is held at the first target stoke speed. The controller 36 controls the right lift cylinder 23 based on feedback control so that the stroke speed of the right lift cylinder 23 is held at the second target stoke speed. The controller 36 controls the drawbar shift cylinder 24 based on feedback control so that the stroke speed of the drawbar shift cylinder 24 is held at the third target stoke speed.

The controller 36 increases the first to third gains as the vehicle speed increases. Consequently, for example when the vehicle speed is high, the blade 16 can move quickly. Consequently, a response to a quick change in the orientation of the vehicle body 2 is facilitated when working at high speed. Alternatively, when the vehicle speed is low, the occurrence of overshooting can be prevented whereby the blade 16 is operable with stability. Consequently, the accuracy of work by the blade 16 is improved when working at a low speed.

In step S107, the controller 36 controls the actuators based on the target stroke speeds. In the above example, the controller 36 controls the control valve 34 so that the left lift cylinder 22 performs a stroke motion at the first target stoke speed. The controller 36 controls the control valve 34 so that the right lift cylinder 23 performs a stroke motion at the second target stoke speed. The controller 36 controls the control valve 34 so that the drawbar shift cylinder 24 performs a stroke motion at the third target stoke speed. Consequently, as illustrated in FIG. 12, the height of the left end part 161 of the blade 16 is changed in accordance with the operation of the left lift lever 41 while the height of the right end part 162 of the blade 16 and the position in the left-right direction of the drawbar 17 are held constant.

As described above, when the left lift lever 41 is operated, the controller 36 reproduces the target orientation of the work implement 5 corresponding to the operation of the left lift lever 41 with a combination of the stroke motions of the left lift cylinder 22, the right lift cylinder 23, and the drawbar shift cylinder 24. The controller 36 reproduces the target orientation of the work implement 5 corresponding to the operation of the operating members by combining the motions of the plurality of actuators 22-27 in the same way when another operating member is operated.

For example, as illustrated in FIG. 9, when the right lift lever 42 is operated, the controller 36 actuates the left lift cylinder 22, the right lift cylinder 23, and the drawbar shift cylinder 24. In the same way as the left lift cylinder 22, when a stroke motion of the right lift cylinder 23 is performed, the height of the left end part 161 of the blade 16 and the position in the left-right direction of the drawbar 17 change together with the height of the right end part 162 of the blade 16 in accordance with the stroke motion of the right lift cylinder 23.

As a result, the controller 36 determines the pitch angle θ2 and the roll angle θ3 of the drawbar 17 as the target orientation so that the height of the right end part 162 of the blade 16 becomes the height corresponding to the operation of the right lift lever 42 while holding the height of the left end part 161 of the blade 16 and the yaw angle θ1 of the drawbar 17 constant when the right lift lever 42 is operated. The controller 36 reproduces the target orientation of the work implement 5 corresponding to the operation of the right lift lever 42 with a combination of the stroke motions of the left lift cylinder 22, the right lift cylinder 23, and the drawbar shift cylinder 24.

Figure 14A:
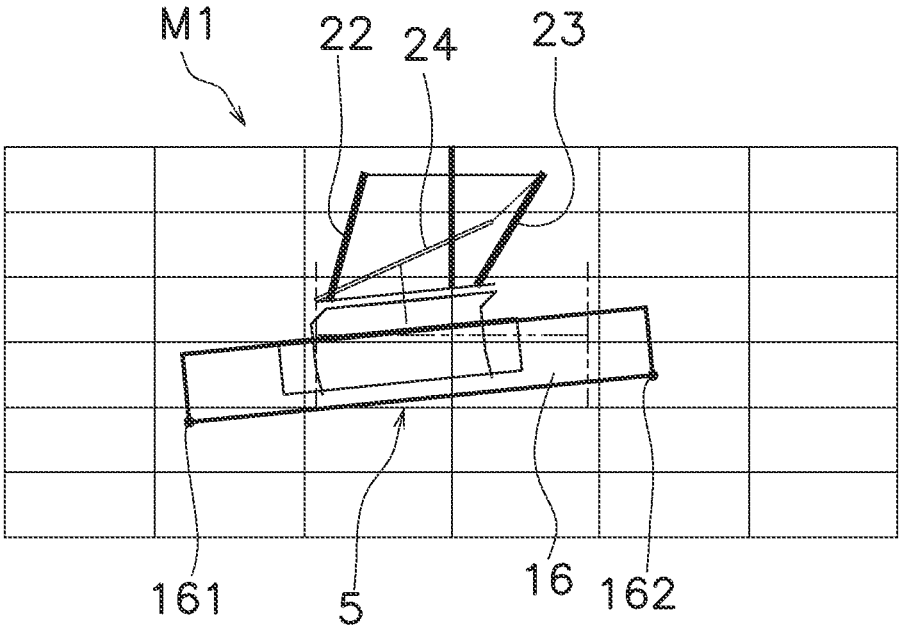
FIG. 14A and FIG. 14B are rear views of a geometric model illustrating an orientation of the work implement.

When the drawbar shift lever 43 is operated, the controller 36 actuates the left lift cylinder 22, the right lift cylinder 23, and the drawbar shift cylinder 24. FIG. 14A illustrates the work implement 5 when the drawbar shift cylinder 24 performs a stroke motion from the initial state in a conventional motor grader. When the drawbar shift cylinder 24 performs a stroke motion in the conventional motor grader as illustrated in FIG. 14A, the height of the left end part 161 and the height of the right end part 162 of the blade 16 also change in accordance with the stroke motion of the drawbar shift cylinder 24. In addition, the yaw angle θ1 of the drawbar 17 changes in accordance with the stroke motion of the drawbar shift cylinder 24.

Figure 14B:
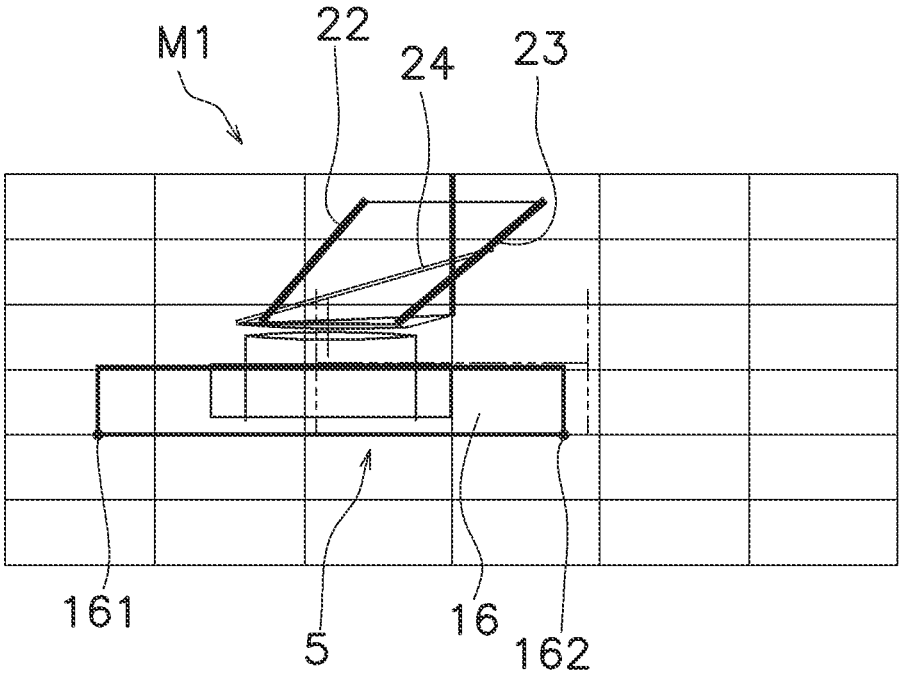

Accordingly, when the drawbar shift lever 43 is operated in the work machine 1 according to the present embodiment, the controller 36 determines the pitch angle θ2 and the roll angle θ3 of the drawbar 17 as the target orientation so that the yaw angle θ1 of the drawbar 17 becomes the angle corresponding to the operation of the drawbar shift lever 43 while holding the height of the left end part 161 and the height of the right end part 162 of the blade 16 constant as illustrated in FIG. 14B. The controller 36 then reproduces the target orientation of the work implement 5 corresponding to the operation of the drawbar shift lever 43 with a combination of the stroke motions of the left lift cylinder 22, the right lift cylinder 23, and the drawbar shift cylinder 24.

Figure 15A:
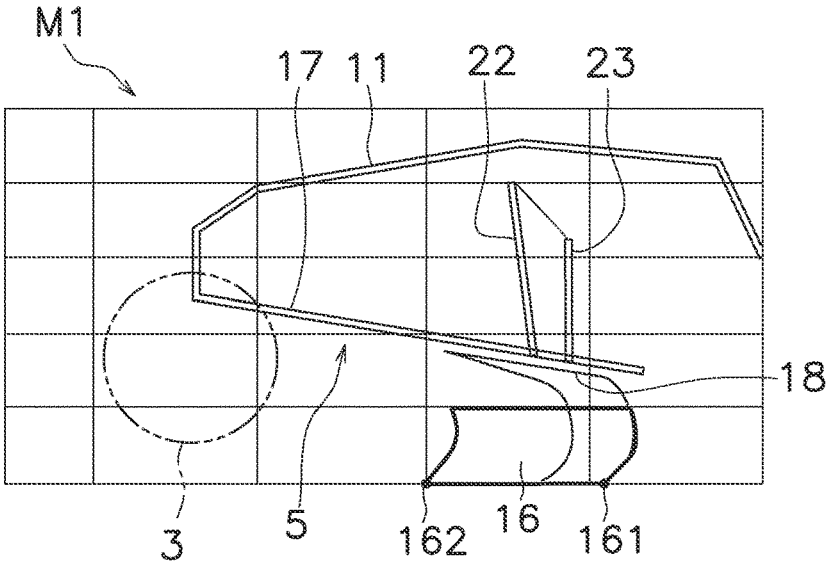
FIG. 15A, FIG. 15B and FIG. 15C are side views of a geometric model illustrating an orientation of the work implement.
Figure 15B:
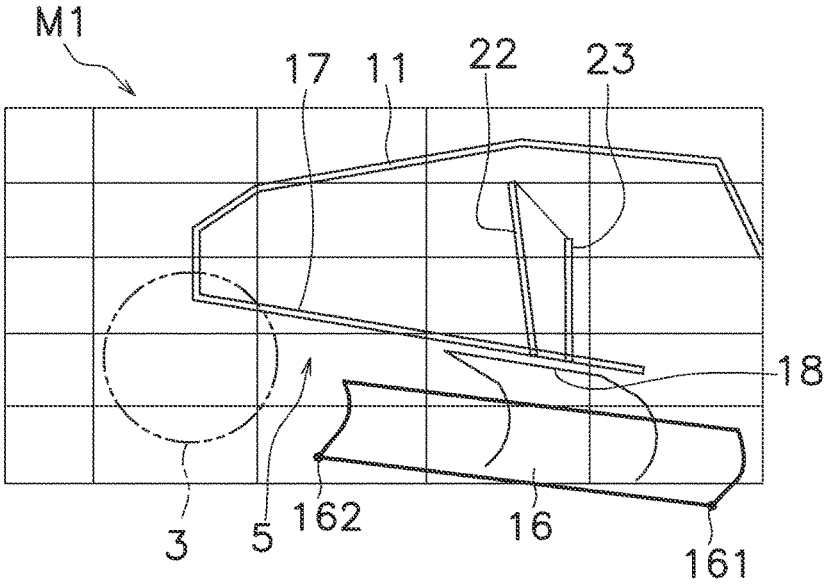

When the rotation lever 44 is operated, the controller 36 actuates the left lift cylinder 22, the right lift cylinder 23, the drawbar shift cylinder 24, and the rotation actuator 27. FIG. 15A is a side view of the work implement 5 in the initial state. FIG. 15B illustrates the work implement 5 when the circle 18 is rotated from the initial state in a conventional motor grader. When the circle 18 rotates due to the rotation actuator 27 in the conventional motor grader, the height of the left end part 161 and the height of the right end part 162 of the blade 16 also change in accordance with the rotation of the circle 18 as illustrated in FIG. 15B. The rotation angle θ4 of the circle 18 also changes in accordance with the rotation of the circle 18.

Figure 15C:
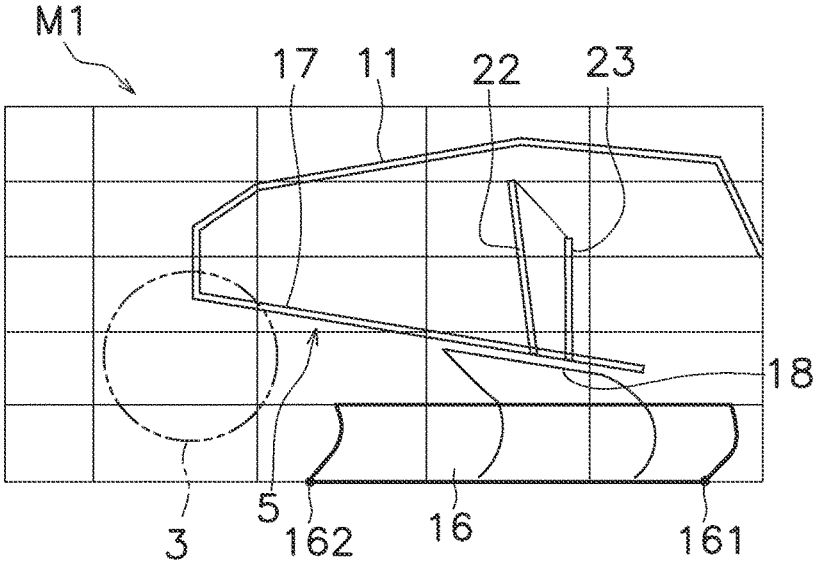

Accordingly, when the rotation lever 44 is operated in the work machine 1 according to the present embodiment, the controller 36 determines the yaw angle θ1, the pitch angle θ2, and the roll angle θ3 of the drawbar 17 as the target orientation so that the rotation angle θ4 of the circle 18 becomes the rotation angle θ4 corresponding to the operation of the rotation lever 44 while holding the height of the left end part 161 and the height of the right end part 162 of the blade 16 constant as illustrated in FIG. 15C. The controller 36 then reproduces the target orientation of the work implement 5 corresponding to the operation of the rotation lever 44 with a combination of the stroke motions of the left lift cylinder 22, the right lift cylinder 23, the drawbar shift cylinder 24, and the rotation actuator 27.

Figure 16A:
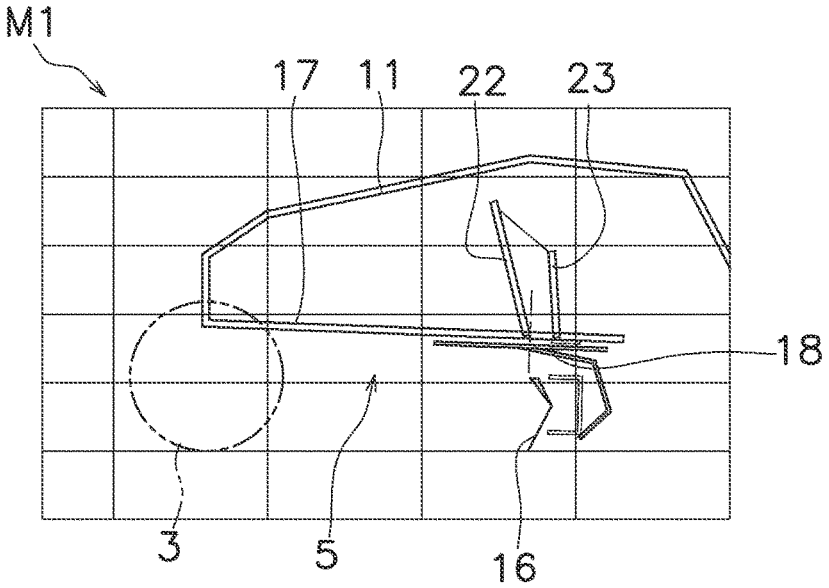
FIG. 16A, FIG. 16B and FIG. 16C are side views of a geometric model illustrating an orientation of the work implement.
Figure 16B:
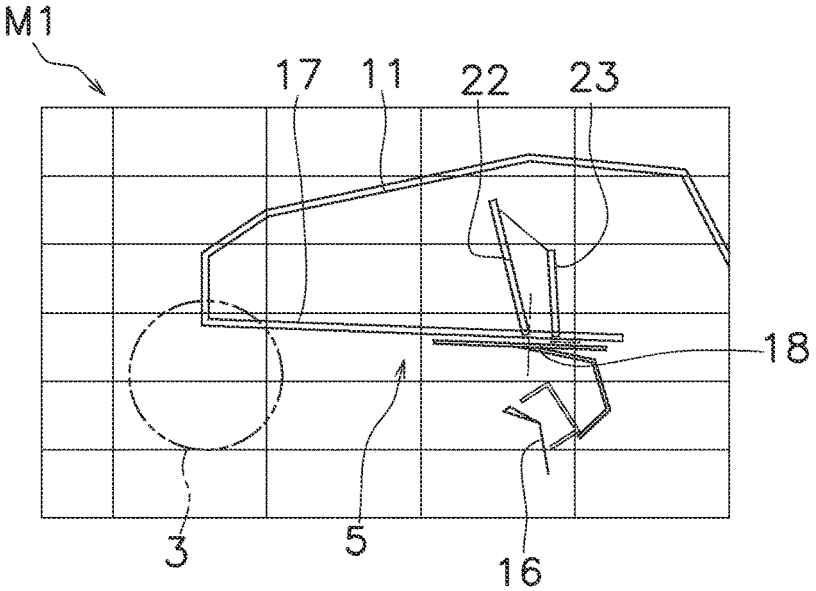

When the blade tilt lever 45 is operated, the controller 36 actuates the left lift cylinder 22, the right lift cylinder 23, the drawbar shift cylinder 24, and the blade tilt cylinder 25. FIG. 16A is a side view of the work implement 5 in the initial state. FIG. 16B illustrates the work implement 5 when the blade tilt cylinder 25 performs a stroke motion from the initial state in a conventional motor grader. In the conventional motor grader, the height of the blade 16 also changes in accordance with the stroke motion of the blade tilt cylinder 25 when the tilt cylinder performs a stroke motion as illustrated in FIG. 16B. The tilt angle θ5 of the blade 16 also changes in accordance with the stroke motion of the blade tilt cylinder 25.

Figure 16C:
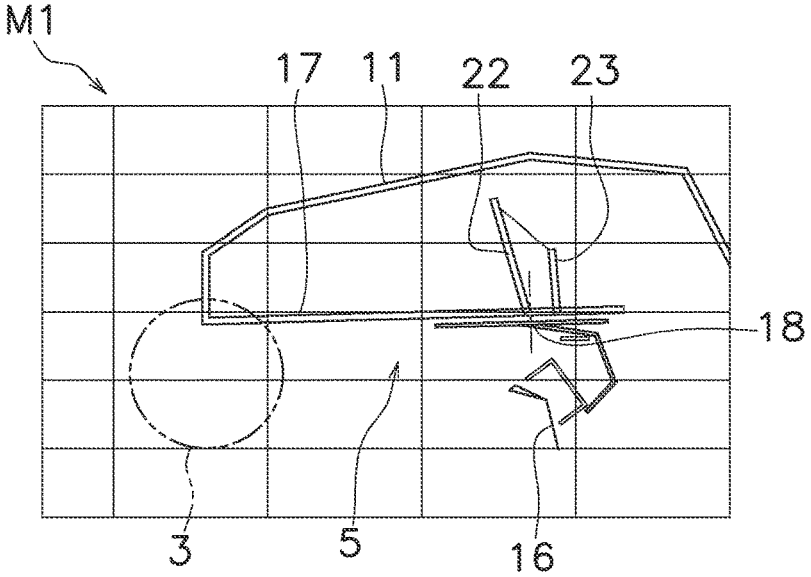

Accordingly, when the blade tilt lever 45 is operated in the work machine 1 according to the present embodiment, the controller 36 determines the yaw angle θ1, the pitch angle θ2, and the roll angle θ3 of the drawbar 17 as the target orientation so that the tilt angle θ5 of the blade 16 becomes the angle corresponding to the operation of the blade tilt lever 45 while holding the height of the blade 16 constant as illustrated in FIG. 16C. The controller 36 then reproduces the target orientation of the work implement 5 corresponding to the operation of the blade tilt lever 45 with a combination of the stroke motions of the left lift cylinder 22, the right lift cylinder 23, the drawbar shift cylinder 24, and the blade tilt cylinder 25.

When the blade shift lever 46 is operated, the controller 36 controls the blade shift cylinder 26 so that the shift amount of the blade 16 becomes the amount corresponding to the operation of the blade shift lever 46.

In the work machine 1 according to the present embodiment discussed above, the target orientation of the work implement 5 is determined in accordance with the operation of the operating device 35. The respective target stroke lengths of the plurality of hydraulic cylinders 22-26 and the rotation angle θ4 of the rotation actuator 27 are determined so that the work implement 5 assumes the target orientation with a combination of the stroke motions of the plurality of hydraulic cylinders 22-26. Each of the plurality of hydraulic cylinders 22-26 and the rotation actuator 27 are then controlled based on the determined target stroke lengths and the rotation angle θ4. Consequently, the stroke motions of the plurality of hydraulic cylinders 22-26 and the rotation motion of the rotation actuator 27 are combined with a simple operation of the operating device 35, whereby the work implement 5 assumes the target orientation. As a result, the operation of the work implement 5 is facilitated in the work machine 1.

For example, by the operator only operating the left lift lever 41, the height of the left end part 161 of the blade 16 can be changed while holding the height of the right end part 162 of the blade 16 and the position in the left-right direction of the drawbar 17 constant. By the operator only operating the right lift lever 42, the height of the right end part 162 of the blade 16 can be changed while holding the height of the left end part 161 of the blade 16 and the position in the left-right direction of the drawbar 17 constant.

By the operator only operating the drawbar shift lever 43, the yaw angle θ1 of the drawbar 17 can be changed while holding the height of the left end part 161 and the height of the right end part 162 of the blade 16 constant. By the operator only operating the rotation lever 44, the rotation angle θ4 of the circle 18 can be changed while holding the height of the left end part 161 and the height of the right end part 162 of the blade 16 constant. By the operator only operating the blade tilt lever 45, the tilt angle θ5 of the blade 16 can be changed while holding the height of the left end part 161 and the height of the right end part 162 of the blade 16 constant.

Although an embodiment of the present invention has been described so far, the present invention is not limited to the above embodiment and various modifications may be made within the scope of the invention.

The work machine 1 is not limited to a motor grader and may be another machine such as a bulldozer. The parameters representing the orientation of the work implement 5 are not limited to the above embodiment and may be changed. The plurality of operating members 41-46 are not limited to the above embodiment and may be changed. For example, the operating member is not limited to a lever and may be another member such as a joystick, a switch, or a touch panel.

The sensors for detecting the orientation of the work implement 5 are not limited to the above embodiment and may be changed. For example, inertial measurement devices (IMU) may be used. The IMUs may be respectively mounted to the drawbar 17, the front frame 11, and the vehicle body 2. The orientations of the drawbar 17 and the front frame 11 may be detected by the IMUs.

Figure 17:
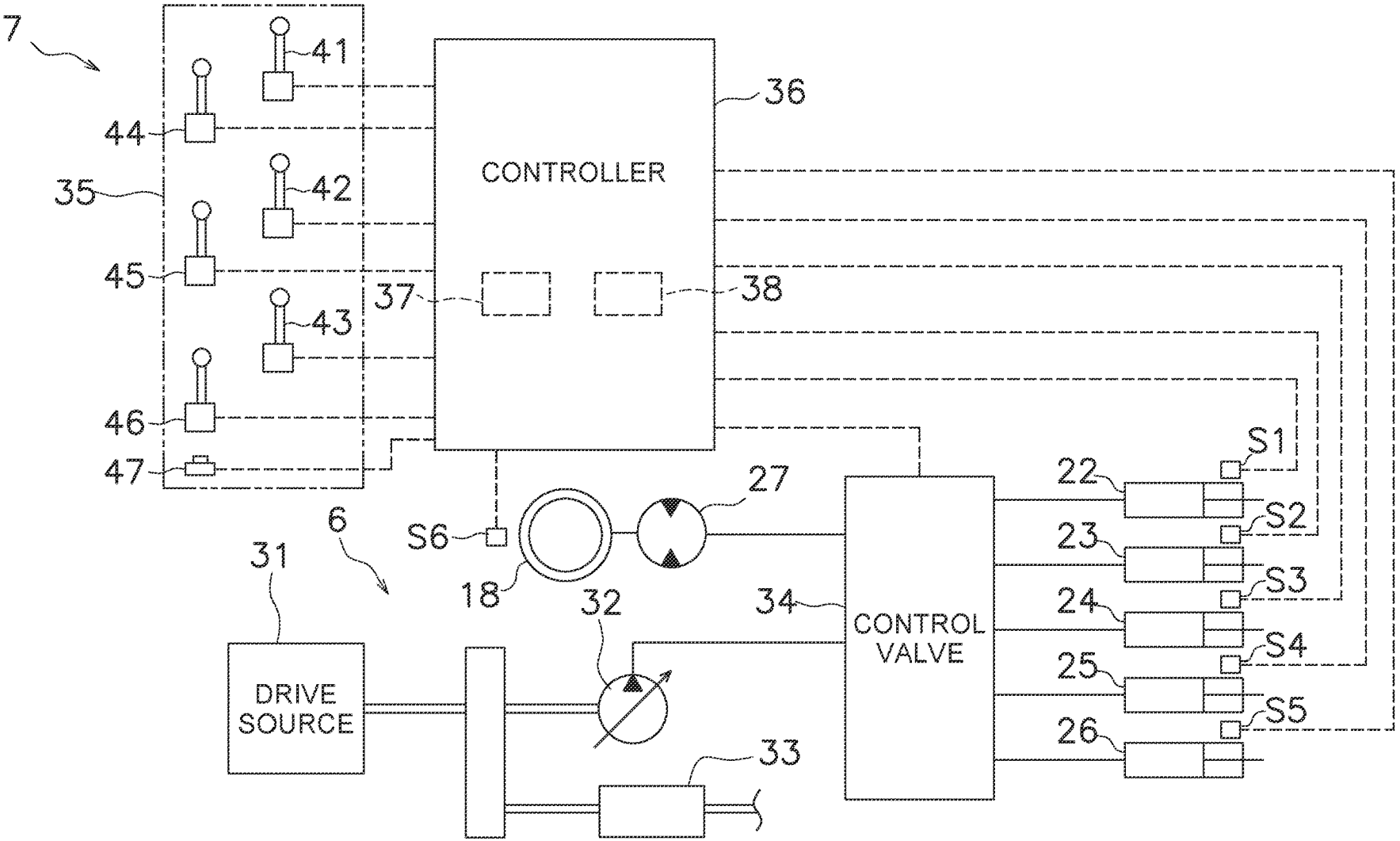
FIG. 17 is a schematic view of a drive system and a control system of the work machine according to a first modified example.

The control for changing the orientation of the work implement 5 based on the operation of the operating device 35 is not limited to the above embodiment and may be changed. FIG. 17 is a schematic view illustrating the drive system 6 and the control system 7 of the work machine 1 according to a first modified example. As illustrated in FIG. 17, the operating device 35 may also include a mode switching member 47. The mode switching member 47 is operable by an operator for switching the control for changing the orientation of the work implement 5 between the control (referred to below as "integrated control mode") according to the above embodiment and a direct control mode. The mode switching member 47 is a switch for example. Alternatively, the mode switching member 47 may be another member such as a lever or a touch panel.

The operator selects either of the integrated control mode or the direct control mode with the mode switching member 47. The mode switching member 47 outputs a mode switching command that indicates whether the integrated control mode or the direct control mode is selected. The controller 36 acquires the mode switching command. The controller 36 determines whether the integrated control mode or the direct control mode is selected due to the mode switching command.

In the integrated control mode as in the above embodiment, the stroke motions of the plurality of hydraulic cylinders 22-26 and the rotation motion of the rotation actuator 27 are combined in accordance with the operation of the operating device 35, whereby the work implement 5 assumes the target orientation.

In the direct control mode, the controller 36 actuates only the one actuator corresponding to the operated operating member with respect to any of the plurality of operating members 41-46. For example, the controller 36 actuates only the left lift cylinder 22 in accordance with the operation of the left lift lever 41. The controller 36 actuates only the right lift cylinder 23 in accordance with the operation of the right lift lever 42.

The controller 36 actuates only the drawbar shift cylinder 24 in accordance with the operation of the drawbar shift lever 43. The controller 36 actuates only the blade tilt cylinder 25 in accordance with the operation of the blade tilt lever 45. The controller 36 actuates only the blade shift cylinder 26 in accordance with the operation of the blade shift lever 46. The controller 36 actuates only the rotation actuator 27 in accordance with the operation of the rotation lever 44.

The controller 36 determines the target stoke speed of the corresponding actuator with respect to the operating amount of the operating member operated among the plurality of operating members 41-46. The controller 36 controls the actuator so that the actuator corresponding to the operated operating member is actuated at the target stoke speed.

In the first modified example discussed above, the operator is able to switch the control for changing the orientation of the work implement 5 between the integrated control mode and the direct control mode by operating the mode switching member 47. Consequently, the operability of the work implement 5 with the operating device 35 is improved.

Figure 18:
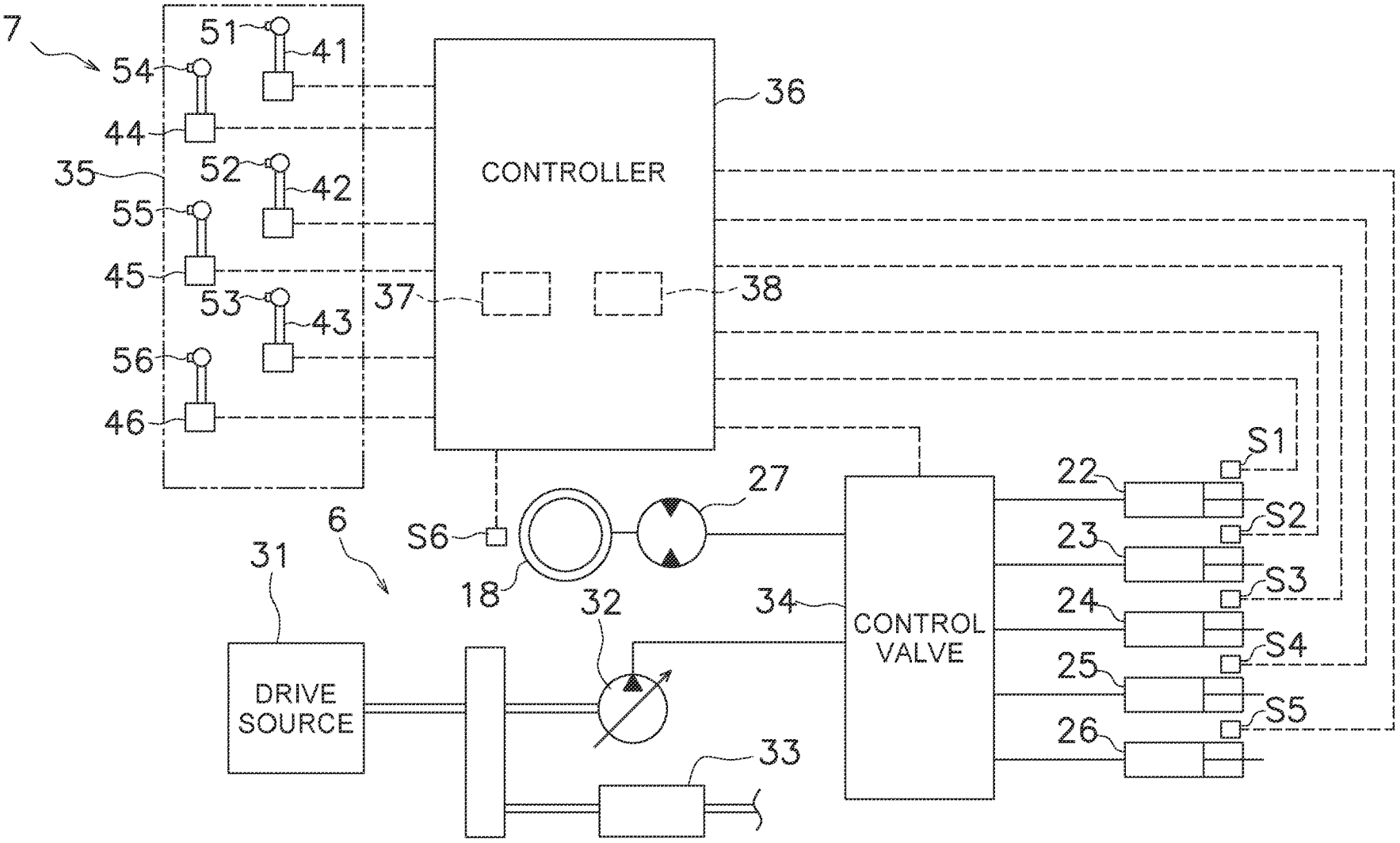
FIG. 18 is a schematic view of a drive system and a control system of the work machine according to a second modified example.

FIG. 18 is a schematic view illustrating the drive system 6 and the control system 7 of the work machine 1 according to a second modified example. As illustrated in FIG. 18, the operating device 35 may also include a plurality of cancel buttons 51-56. The plurality of cancel buttons 51-56 include first to sixth cancel buttons 51-56. The cancel buttons 51-56 are respectively provided to the plurality of operating members 41-46.

The cancel buttons 51-56 each output cancel commands indicating that the cancel buttons 51-56 have been pressed. The controller 36 acquires the cancel commands. The controller 36 determines whether any of the cancel buttons 51-56 have been pressed with the cancel commands.

The controller 36 controls the actuators 22-27 in the integrated control mode in accordance with the operation of the operating members 41-46 when the cancel buttons 51-56 are not pressed. The controller 36 controls one actuator corresponding to the operating member in the direct control mode in accordance with the operation of the operating member corresponding to the pressed cancel button when any of the cancel buttons 51-56 have been pressed.

For example, when the first cancel button 51 is not pressed and the left lift lever 41 is operated, the controller 36 controls the actuators in accordance with the operation of the left lift lever 41 based on the integrated control mode. When the left lift lever 41 is operated while the first cancel button 51 is being pressed, the controller 36 actuates only the left lift cylinder 22 in accordance with the operation of the left lift lever 41 based on the direct control mode.

For example, when the second cancel button 52 is not pressed and the right lift lever 42 is operated, the controller 36 controls the actuators 22-27 in accordance with the operation of the right lift lever 42 based on the integrated control mode. When the right lift lever 42 is operated while the second cancel button 52 is being pressed, the controller 36 actuates only the right lift cylinder 23 in accordance with the operation of the right lift lever 42 based on the direct control mode.

When the third cancel button 53 is not pressed and the drawbar shift lever 43 is operated, the controller 36 controls the actuators 22-27 in accordance with the operation of the drawbar shift lever 43 based on the integrated control mode. When the drawbar shift lever 43 is operated while the third cancel button 53 is being pressed, the controller 36 actuates only the drawbar shift cylinder 24 in accordance with the operation of the drawbar shift lever 43 based on the direct control mode.

When the fourth cancel button 54 is not pressed and the rotation lever 44 is operated, the controller 36 controls the actuators 22-27 in accordance with the operation of the rotation lever 44 based on the integrated control mode. When the rotation lever 44 is operated while the fourth cancel button 54 is being pressed, the controller 36 actuates only the rotation actuator 27 in accordance with the operation of the rotation lever 44 based on the direct control mode.

When the fifth cancel button 55 is not pressed and the blade tilt lever 45 is operated, the controller 36 controls the actuators 22-27 in accordance with the operation of the blade tilt lever 45 based on the integrated control mode. When the blade tilt lever 45 is operated while the fifth cancel button 55 is being pressed, the controller 36 actuates only the blade tilt cylinder 25 in accordance with the operation of the blade tilt lever 45 based on the direct control mode.

When the sixth cancel button 56 is not pressed and the blade shift lever 46 is operated, the controller 36 controls the actuators 22-27 in accordance with the operation of the blade shift lever 46 based on the integrated control mode. When the blade shift lever 46 is operated while the sixth cancel button 56 is being pressed, the controller 36 actuates only the blade shift cylinder 26 in accordance with the operation of the blade shift lever 46 based on the direct control mode.

In the second modified example as discussed above, when an operating member is operated while the cancel button is being pressed, the integrated control mode is temporarily canceled while the cancel button is pressed, and only the actuator corresponding to the operated operating member is actuated based on the direct control mode. As a result, the operator is able to select the integrated control mode and the direct control mode by operating or not operating the cancel button. Consequently, the operability of the work implement 5 with the operating device 35 is improved.

According to the present invention, the operation for changing the orientation of the work implement is facilitated in the work machine.

What is claimed is:

1. A work machine comprising:

a vehicle body;

a work implement movably connected to the vehicle body;

a plurality of actuators that are connected to the work implement and change an orientation of the work implement with respect to the vehicle body;

an operating device that is operable to change the orientation of the work implement;

a sensor that detects the orientation of the work implement; and a controller configured to acquire a current orientation of the work implement from the sensor, determine a target orientation of the work implement corresponding to an operation of the operating device, determine respective target stroke lengths of the plurality of actuators so that the work implement assumes the target orientation from the current orientation with a combination of stroke motions of the plurality of actuators, and control the plurality of actuators based on the target stroke lengths, the orientation of the work implement being defined by a plurality of parameters that represent at least one of a position and a direction of the work implement with respect to the vehicle body, the plurality of parameters including a first parameter and a second parameter, the operating device including a first operating member that is operable to change the first parameter, and the plurality of actuators including a first actuator and a second actuator, the second parameter changing along with a changing of the first parameter in accordance with the stroke motion of the first actuator, at least the second parameter changing with the stroke motion of the second actuator. and the controller being further configured to determine a first target stroke length of the first actuator and a second target stroke length of the second actuator to change the first parameter in accordance with the operation of the first operating member and hold the second parameter constant, control the first actuator based on the first target stroke length, and control the second actuator based on the second target stroke length.

2. The work machine according to claim 1, wherein the operating device further includes a second operating member that is operable to change the second parameter, the first parameter changes along with a changing of the second parameter in accordance with the stroke motion of the second actuator, and the controller is configured to determine the first target stroke length and the second target stroke length to change the second parameter in accordance with the operation of the second operating member and hold the first parameter constant, control the first actuator based on the first target stroke length, and control the second actuator based on the second target stroke length.

3. The work machine according to claim 1, wherein the plurality of parameters further include a third parameter, the plurality of actuators further include a third actuator, the second parameter and the third parameter change along with the changing of the first parameter in accordance with the stroke motion of the first actuator, at least the second parameter changes with the stroke motion of the second actuator, and at least the third parameter changes with the stroke motion of the third actuator, and the controller is configured to determine the first target stroke length, the second target stroke length, and a third target stroke length of the third actuator to change the first parameter in accordance with the operation of the first operating member and hold the second parameter and the third parameter constant, control the first actuator based on the first target stroke length, and control the second actuator based on the second target stroke length, and control the third actuator based on the third target stroke length.

4. The work machine according to claim 3, wherein the work implement includes a supporting member movably connected to the vehicle body, and a blade movably connected to the supporting member, the blade includes a first end part and a second end part in a left-right direction of the vehicle body, the first parameter is a height of the first end part, the second parameter is a height of the second end part, and the third parameter is a yaw angle of the supporting member with respect to the vehicle body.

5. The work machine according to claim 3, wherein the work implement includes a supporting member movably connected to the vehicle body, and a blade movably connected to the supporting member, the blade includes a first end part and a second end part in a left-right direction of the vehicle body, the first parameter is a yaw angle of the supporting member with respect to the vehicle body, the second parameter is a height of the first end part, and the third parameter is a height of the second end part.

6. The work machine according to claim 3, wherein the work implement includes a supporting member movably connected to the vehicle body, and a blade movably connected to the supporting member, the blade includes a first end part and a second end part in a left-right direction of the vehicle body, the first parameter is a tilt angle of the blade, the second parameter is a height of the first end part, and the third parameter is a height of the second end part.

7. The work machine according to claim 1, further comprising:

a rotation actuator that rotates at least a portion of the blade, the controller being configured to determine the target stroke lengths of each of the plurality of actuators and a target rotation angle of the rotation actuator so that the work implement assumes the target orientation with a combination of the stroke motions of the plurality of actuators and a rotation motion of the rotation actuator, control the rotation actuator based on the target rotation angle, control the plurality of actuators based on the target stroke lengths.

8. The work machine according to claim 7, wherein the orientation of the work implement is defined by a plurality of parameters that represent at least one of a position and a direction of the work implement with respect to the vehicle body, the plurality of parameters include a first parameter, a second parameter, and a third parameter, the second parameter and the third parameter change along with a changing of the first parameter in accordance with the rotation motion of the rotation actuator, the plurality of actuators include a first actuator and a second actuator, at least the second parameter changes in accordance with the stroke motion of the first actuator, at least the third parameter changes in accordance with the stroke motion of the second actuator, the operating device includes a first operating member that is operable to change the first parameter, and the controller is configured to determine the target rotation angle, the first target stroke length of the first actuator, and the second target stroke length of the second actuator to change the first parameter in accordance with the operation of the first operating member and hold the second parameter and the third parameter constant, control the rotation actuator based on the target rotation angle, control the first actuator based on the first target stroke length, and control the second actuator based on the second target stroke length.

9. The work machine according to claim 8, wherein the work implement includes a supporting member movably connected at least to the vehicle body, and a blade movably connected to the supporting member, the blade includes a first end part and a second end part in a left-right direction of the vehicle body, the first parameter is a rotation angle of the rotation actuator, the second parameter is a height of the first end part, and the third parameter is a height of the second end part.

10. The work machine according to claim 1, wherein the vehicle body includes a rear frame, and a front frame that extends forward from the rear frame, the work implement includes a drawbar swingably supported at least in an up-down direction and a left-right direction of the vehicle body with respect to the front frame, and a blade supported by the drawbar, and the plurality of actuators include a left lift cylinder that is connected to the drawbar and the front frame and that moves a left end of the blade up and down, a right lift cylinder that is connected to the drawbar and the front frame and that moves a right end of the blade up and down, and a drawbar shift cylinder that is connected to the drawbar and the front frame and that causes the drawbar to swing in the left-right direction of the vehicle body.

11. The work machine according to claim 1, further comprising:

a mode switching member that is operable by an operator in order to switch a control for changing the orientation of the work implement between an integrated control mode and a direct control mode, the plurality of actuators including a first actuator, the operating device including a first operating member, and the controller being configured to determine the target orientation corresponding to an operation of the first operating member, determine respective target stroke lengths of the plurality of actuators so that the work implement assumes the target orientation from the current orientation with a combination of the stroke motions of the plurality of actuators, and control the plurality of actuators based on the target stroke lengths in the integrated control mode, and actuate only the first actuator in accordance with the operation of the first operating member in the direct control mode.

12. The work machine according to claim 1, wherein the plurality of actuators include a first actuator, and the operating device includes a first operating member, and a first cancel button corresponding to the first operating member, and the controller is configured to change the orientation of the work implement based on an integrated control mode when the first cancel button is not operated and the first operating member is operated, determine the target orientation corresponding to an operation of the first operating member, determine respective target stroke lengths of the plurality of actuators so that the work implement assumes the target orientation from the current orientation with a combination of the stroke motions of the plurality of actuators, and control the plurality of actuators based on the target stroke lengths in the integrated control mode, change the orientation of the work implement based on a direct control mode when the first operating member is operated while the first cancel button is being pressed, and actuate only the first actuator in accordance with the operation of the first operating member in the direct control mode.

13. A method for controlling a work machine including a vehicle body, a work implement movably connected to the vehicle body, and a plurality of actuators that are connected to the work implement and change an orientation of the work implement with respect to the vehicle body, the method comprising:

acquiring a current orientation of the work implement from a sensor;

acquiring an operating command for changing the orientation of the work implement;

determining a target orientation of the work implement corresponding to the operating command;

determining respective target stroke lengths of the plurality of actuators so that the work implement assumes the target orientation from the current orientation with a combination of the stroke motions of the plurality of actuators, and controlling the plurality of actuators based on the target stroke lengths, the orientation of the work implement being defined by a plurality of parameters that represent at least one of a position and a direction of the work implement with respect to the vehicle body, the plurality of parameters including a first parameter and a second parameter, the plurality of actuators including a first actuator and a second actuator, the second parameter changing along with a changing of the first parameter in accordance with the stroke motion of the first actuator, at least the second parameter changing with the stroke motion of the second actuator, and the method further comprising:

acquiring a first operating command for changing the first parameter, determining a first target stroke length of the first actuator and a second target stroke length of the second actuator to change the first parameter in accordance with the first operating command and hold the second parameter constant, controlling the first actuator based on the first target stroke length, and controlling the second actuator based on the second target stroke length.

14. The method according to claim 13, wherein
the first parameter changes along with a changing of the second parameter in accordance with the stroke motion of the second actuator, and
the method further comprises:
acquiring a second operating command for changing the second parameter; and
determining the first target stroke length and the second target stroke length to change the second parameter in accordance with the second operating command and hold the first parameter constant.

15. The method according to claim 13, wherein
the plurality of parameters further include a third parameter,
the plurality of actuators further include a third actuator,
the second parameter and the third parameter change along with the changing of the first parameter in accordance with the stroke motion of the first actuator,
at least the second parameter changes with the stroke motion of the second actuator,
at least the third parameter changes with the stroke motion of the third actuator, and the method further comprises:
determining the first target stroke length, the second target stroke length, and a third target stroke length of the third actuator to change the first parameter in accordance with first operating command and hold the second parameter and the third parameter constant; and
controlling the third actuator based on the third target stroke length.

16. The method according to claim 15, wherein
the work implement includes
a supporting member movably connected to the vehicle body, and
a blade movably connected to the supporting member,
the blade includes a first end part and a second end part in a left-right direction of the vehicle body,
the first parameter is a height of the first end part, the second parameter is a height of the second end part, and
the third parameter is a yaw angle of the supporting member with respect to the vehicle body.

17. The method according to claim 15, wherein
the work implement includes
a supporting member movably connected to the vehicle body, and
a blade movably connected to the supporting member,
the blade includes a first end part and a second end part in a left-right direction of the vehicle body,
the first parameter is a yaw angle of the supporting member with respect to the vehicle body,
the second parameter is a height of the first end part, and
the third parameter is a height of the second end part.

18. The method according to claim 15, wherein
the work implement includes
a supporting member movably connected to the vehicle body, and
a blade movably connected to the supporting member,
the blade includes a first end part and a second end part in a left-right direction of the vehicle body,
the first parameter is a tilt angle of the blade,
the second parameter is a height of the first end part, and
the third parameter is a height of the second end part.

19. The method according to claim 13, wherein
the work machine further includes a rotation actuator that rotates at least a portion of the blade, and
the method further comprises:
determining the target stroke lengths of each of the plurality of actuators and a target rotation angle of the rotation actuator so that the work implement assumes the target orientation with a combination of the stroke motions of the plurality of actuators and a rotation motion of the rotation actuator; and
controlling the rotation actuator based on the target rotation angle.

20. The method according to claim 19, wherein
the orientation of the work implement is defined by a plurality of parameters that represent at least one of a position and a direction of the work implement with respect to the vehicle body,
the plurality of parameters include a first parameter, a second parameter, and a third parameter,
the second parameter and the third parameter change along with a changing of the first parameter in accordance with the rotation motion of the rotation actuator,
the plurality of actuators include a first actuator and a second actuator,
at least the second parameter changes in accordance with the stroke motion of the first actuator,
at least the third parameter changes in accordance with the stroke motion of the second actuator, and
the method comprises:
acquiring a first operating signal for changing the first parameter;
determining the target rotation, a first target stroke length of the first actuator, and a second target stroke length of the second actuator to change the first parameter in accordance with the first operating signal and hold the second parameter and the third parameter constant;
controlling the rotation actuator based on the target rotation angle;
controlling the first actuator based on the first target stroke length; and
controlling the second actuator based on the second target stroke length.

21. The method according to claim 13, wherein
the plurality of actuators include a first actuator,
the method further comprises:
acquiring a first operating command for changing the orientation of the work implement; and
acquiring a mode switching command for switching a control for changing the orientation of the work implement between an integrated control mode and a direct control mode,
the integrated control mode includes
determining the target orientation corresponding to the first operating command,
determining respective target stroke lengths of the plurality of actuators so that the work implement assumes the target orientation from the current orientation with a combination of the stroke motions of the plurality of actuators, and
controlling the plurality of actuators based on the target stroke lengths, and
the direct control mode includes actuating only the first actuator in accordance with the first operating command.

22. The method according to claim 14, wherein
the plurality of actuators include a first actuator,
the method further comprises:
acquiring a first operating command for changing the orientation of the work implement;

receiving a first cancel command corresponding to the first operating command;

changing the orientation of the work implement based on an integrated control mode when the first operating command is acquired without the first cancel command; and changing the orientation of the work implement based on a direct control mode when the first operating command is acquired with the first cancel command, the integrated control mode includes determining the target orientation corresponding to the operation of the first operating member, determining respective target stroke lengths of the plurality of actuators so that the work implement assumes the target orientation from the current orientation with a combination of the stroke motions of the plurality of actuators, and controlling the plurality of actuators based on the target stroke lengths, and the direct control mode includes actuating only the first actuator in accordance with the first operating command.

* * * * *